US008942580B2

(12) United States Patent
Yoshida

(10) Patent No.: US 8,942,580 B2
(45) Date of Patent: Jan. 27, 2015

(54) IMAGE FORMING APPARATUS HAVING A PLURALITY OF IMAGE FORMING MODES

(75) Inventor: Masahiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 13/494,292

(22) Filed: Jun. 12, 2012

(65) Prior Publication Data

US 2012/0321329 A1 Dec. 20, 2012

(30) Foreign Application Priority Data

Jun. 15, 2011 (JP) ..... 2011-132877
Apr. 23, 2012 (JP) ..... 2012-097657

(51) Int. Cl.
*G03G 15/16* (2006.01)
*G03G 15/01* (2006.01)
*G03G 15/02* (2006.01)
*G03G 15/00* (2006.01)

(52) U.S. Cl.
CPC ..... *G03G 15/0131* (2013.01); *G03G 15/0266* (2013.01); *G03G 15/50* (2013.01)
USPC ..... 399/38

(58) Field of Classification Search
USPC ..... 399/38, 71, 101, 149, 299
See application file for complete search history.

(56) References Cited

U.S. PATENT DOCUMENTS 7,620,339 B2 * 11/2009 Kubo ..... 399/71
2010/0196030 A1 8/2010 Okubo et al.

FOREIGN PATENT DOCUMENTS

JP 04005679 A * 1/1992
JP 6-175453 A 6/1994

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes an intermediary transfer member, image forming portions each including an image bearing member first transfer portions, cleaning portions, and a controller capable of executing a single-color image forming mode operation in which a developer image of a single color is transferred onto the intermediary transfer member by an image forming operation of one of the image forming portions to form a single-color image. The controller executes, during the execution of the single-color image forming mode operation, a sequence in which the developer image is formed on the image bearing member at the image forming portion which does not operate for the image formation, and a bias voltage for charging the developer to an opposite polarity to a normal charge polarity of the developer is applied to the first transfer portion to permit the charged developer to reach the cleaning portion.

28 Claims, 10 Drawing Sheets

(a)

(b)

IMAGE FORMING APPARATUS HAVING A PLURALITY OF IMAGE FORMING MODES

FIELD OF THE INVENTION AND RELATED ART

The present invention relates to an image forming apparatus of a tandem (in-line) type in which a multi-color image or a single-color image can be formed on a recording material (print medium) by mode selection.

An electrophotographic color image forming apparatus of the tandem type, such as a color copying machine or a color printer will be described as an example. This apparatus includes a plurality of juxtaposed electrophotographic image forming portions. Further, at the image forming portions, developer images (toner images) different in color on electrophotographic photosensitive members (image bearing members) and then successively transfer the toner images superposedly to record synthetic color images (multi-color images), thus facilitating speed-up of image formation.

The image forming apparatus of the in-line type is classified into an intermediary transfer type (indirect transfer type) and a direct transfer type depending of a difference in transfer type. In the intermediary transfer type, toner images formed on the photosensitive members of the plurality of juxtaposed image forming portions are once successively transferred superposedly onto the intermediary transfer member by primary transfer devices to obtain synthetic color images. Then, the color images are collectively secondary-transferred onto the recording material by a secondary transfer device. On the other hand, in the direct transfer type, the toner images formed on the photosensitive members of the plurality of juxtaposed image forming portions are successively directly transferred superposedly onto the recording material carried and conveyed by a recording material conveying member by a transfer device to form synthetic color images.

In an image forming process using electrophotography, in general, the surface of the photosensitive member is charged by a charging device and then an electrostatic latent image is formed on the photosensitive member by an exposure device. Thereafter, the electrostatic latent image is developed with a toner (developer) to be visualized by a developing device, and then a resultant developer image is transferred onto the recording material by a transfer device and is fixed as a fixed image by a fixing device and then is finally discharged, as a print, to the outside of the image forming apparatus. Further, a so-called transfer residual toner remaining on the photosensitive member surface without being transferred by a transfer device is removed by a cleaning device and then a subsequent charging process is performed.

As the photosensitive member, an organic photosensitive member prepared by providing on a support a photosensitive layer (organic photosensitive layer) using an organic material as photoconductive substances (charge-generating substance and charge-transporting substance) becomes widespread from the advantages such as low cost and high productivity. As the organic photosensitive member, from the advantage of high sensitivity and diversity of material design, a photosensitive member having a lamination type photosensitive layer consisting of lamination of a charge generation layer of the charge-generating substance and a charge transport layer of the charge-transporting substance goes mainstream. Incidentally, as a binder resin for the charge transport layer of the photosensitive member, polycarbonate resin or polyarylate resin for enhancing mechanical strength is widely used.

As for the charging device, as a constitution which realizes inexpensiveness and ozone-less charging, a contact charging roller type in which a charging roller constituted by forming an elastic rubber material or the like on a core metal is contacted to the photosensitive member with a predetermined pressure and thus is rotated by the rotation of the photosensitive member is widely used. Electric discharge is generated by applying a predetermined bias to the core metal, so that the photosensitive member obtains a predetermined surface potential.

The developing device is constituted by a developer accommodating chamber containing the toner as the developer, a developing roller for conveying the toner to the photosensitive member, and a developer regulating member for providing electric charge to the toner and for uniformly coating the toner in a thin layer on the developing roller, and the like. As the toner for a full-color electrophotographic apparatus, a non-magnetic one-component toner is generally used. As a developing type capable of inexpensiveness and downsizing, a contact developing type in which the toner is directly coated on the developing roller constituted by the elastic rubber material or the like and then the developing roller is contacted to the photosensitive member to develop the electrostatic latent image under application of a predetermined bias is widely used.

The cleaning device is constituted by a charging bias formed at an elastic rubber material such as urethane rubber and a residual toner container for accommodating the removed toner, and the like. As a cleaning process, a method in which the charging bias is counter directionally contacted to the photosensitive member with a predetermined pressure to physically scrape off the transfer residual toner from the photosensitive member surface thereby to effect cleaning is widely used.

Onto the surface layer as the photosensitive member charge transport layer (hereinafter referred to as a CT layer), as described above, electrical and mechanical forces are applied by an electric discharge process by the charging, friction by the developing roller and the intermediary transfer member, the scraping with the charging bias, and the like in the image forming process. As a result, the CT layer is worn to cause abrasion (wearing). In order to address this problem, various proposals for determining the life time of the photosensitive member within the range not lowering levels of abrasion non-uniformity and fog or the like by estimating an abrasion amount in an apparatus main assembly have been made.

Further, the developing device has the tendency such that an external additive for controlling flowability, chargeability and the like of the toner is decreased in amount from the surface of a toner base material when image formation is repeated, and thus the flowability and chargeability of the toner are gradually lowered (so-called a toner deterioration phenomenon). When the toner deterioration is advanced, filming or the like such that the toner is melted (fused) on the developing roller occurs, so that a vertical stripe can generate on an image. In order to suppress this deterioration, countermeasures such as decreases in rotation number of the developing roller and an opportunity for contact to the photosensitive member to the possible extent are taken.

On the other hand, in the full-color electrophotographic apparatus, as described above, the tandem type in which the plurality of members for the respective colors are juxtaposed is advantageous for the speed-up of the printing speed and is a widely employed constitution. Generally, as the toners in the full-color electrophotographic apparatus, four color toners of yellow, magenta, cyan and black are used, and by appropriately superposing the respective toners, the color can be reproduced freely.

In the tandem type, a type in which the above-described photosensitive member, charging device, developing device and cleaning device are arranged on (above), the intermediary transfer member as each of units (image forming portions) for the respective colors (hereinafter each of the image forming portions is referred to as (image forming) station) is widely used. In the image forming process, the toners (toner images) subjected to the development on the photosensitive members at the respective units are superposed on the intermediary transfer member at the respective units and then are collectively secondary-transferred onto the printing medium such as paper.

Further, there is a cartridge type in which members, having close life times, such as the photosensitive member, the charging device, the developing device and the cleaning device are integrally assembled. By this type, when the life time of a cartridge reaches its end due to no toner or the like, parts having the close life times are replaced at the same time by making cartridge exchange, so that it is possible to not only maintain an image level but also realize maintenance-free apparatus. Therefore, in the full-color image forming apparatus, the type in which the cartridges containing the color toners of yellow, magenta, cyan and black are provided at the respective stations has become widespread.

Further, in the full-color electrophotographic (image forming) apparatus, it is also possible to effect printing (operation in a single-color image forming mode) of a monochromatic color (black) in general (hereinafter, this printing mode is referred to as a monochromatic mode). In the monochromatic mode, it is ideal that the photosensitive members and the developing devices for the colors other than black are not used since the life times of these members for the colors other than black are not shortened. However, such an apparatus invites increases in size and cost of the apparatus with complication of a driving device or the like and therefore in some cases, in the operation in the monochromatic mode, although the development for other colors (the colors other than black) is not effected, the drums for the whole colors are rotated (Japanese Laid-Open Patent Application Hei 6-175453).

Also in such an operation in the monochromatic mode, in the image forming apparatus such that the photosensitive members which are not subjected to the image formation are rotated, the photosensitive member abrasion occurs although the image formation is not effected. Powder of the abraded photosensitive member (hereinafter referred to as abrasion powder) is gradually accumulated in a wedge-like region between the photosensitive member and the charging bias of the cleaning device. When the operation in the monochromatic mode is continued, in the region, a phenomenon such that fine particles such as the abrasion powder and other fine particles are gradually accumulated in a large amount is generated. The accumulated fine particles such as the abrasion power can pass through the charging bias at the same time in a state such that distortion drastically occurs at an end of the charging bias. The state such that distortion drastically occurs at an end of the charging bias is, e.g., such that drive of the photosensitive member is resumed from a state in which the photosensitive member is stopped. The fine particles passing through the charging bias are deposited on the charging roller, thus causing a lateral stripe-like contamination of the charging roller.

When the charging roller is contaminated with the fine particles such as the photosensitive member abrasion powder, the charging of the photosensitive member (photosensitive drum) by the charging roller becomes non-uniform. Therefore, at other color image forming stations, when the image was outputted in the operation in the full-color mode after many images were formed in the operation in the monochromatic mode, a lateral white stripe was generated with a period (cycle) of the charging roller in some cases.

SUMMARY OF THE INVENTION

The present invention has been accomplished by solving the above-described problems.

A principal object of the present invention is to provide an image forming apparatus capable of suppressing a lateral stripe-like contamination of a charging roller with fine particles such as photosensitive member abrasion powder to prevent an occurrence of a lateral white stripe with a period of the charging roller.

According to an aspect of the present invention, there is provided an image forming apparatus for forming an image on a recording material, comprising: an intermediary transfer member onto which a plurality of developer images are to be transferred; a plurality of image forming portions provided along a movement direction of the intermediary transfer member, wherein each of the image forming portions includes a rotatable image bearing member, a rotatable charging roller for electrically charging uniformly a surface of the image bearing member in contact with the image bearing member, and developing means for developing an electrostatic latent image formed on the image bearing member into the developer image by reverse development; a plurality of first transfer means, provided correspondingly to the image bearing members of the image forming portions, respectively, each for transferring the developer image from the image bearing member onto the intermediary transfer member; a plurality of cleaning means, provided correspondingly to the image bearing members of the image forming portions, respectively, where is each of the cleaning means includes a cleaning blade and is configured to remove a developer remaining on the image bearing member after the developer image is transferred from the image bearing member onto the intermediary transfer member; second transfer means for transferring the plurality of developer images from the intermediary transfer member onto the recording material; and control means for executing, by mode selection, an operation in a multi-color image forming mode in which the developer images of a plurality of colors are superposed on the intermediary transfer member by image forming operations of the image forming portions to effect multi-color image formation and an operation in a single-color image forming mode in which the developer image of a single color is transferred onto the intermediary transfer member by an image forming operation of one of the image forming portions to effect single-color image formation, wherein the control means executes, during the execution of the operation in the single-color image forming mode, a sequence in which the developer image is formed on the image bearing member at the image forming portion which is not subjected to the image formation, a bias for charging the developer for the developer image to an opposite polarity to a normal charge polarity of the developer is applied to the first transfer means, and the developer charged to the opposite polarity is conveyed to the cleaning means.

According to the image forming apparatus of the present invention, it is possible to suppress the lateral stripe-like contamination with the fine particles such as the photosensitive member abrasion powder to prevent the occurrence of the lateral white stripe with the period of the charging roller.

These and other objects, features and advantages of the present invention will become more apparent upon a consideration of the following description of the preferred embodiments of the present invention taken in conjunction with the accompanying drawings.

Figure 9:
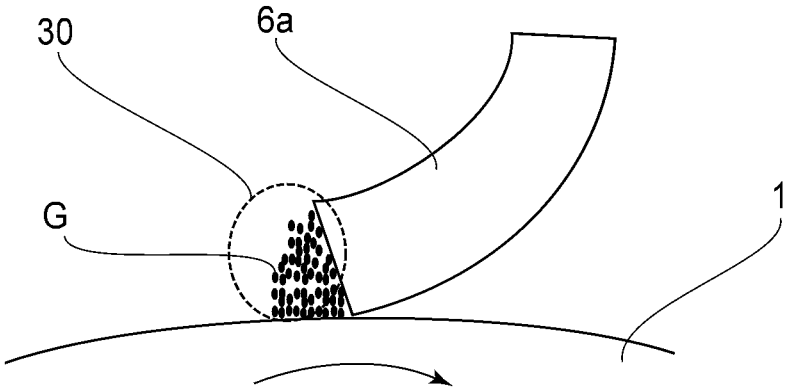
Figure 9:
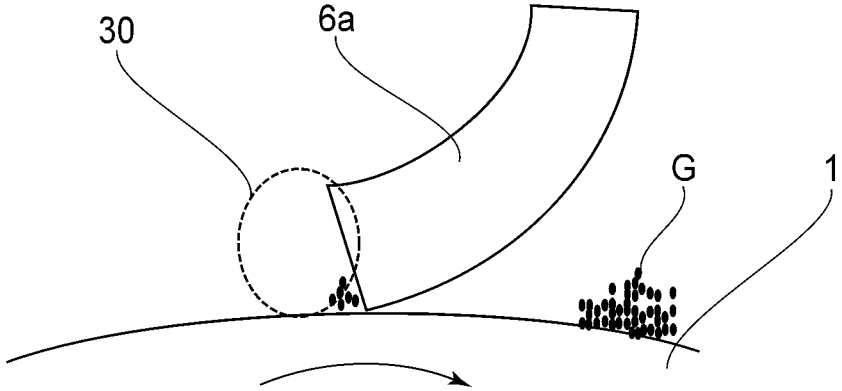

Parts (a) and (b) of FIG. 9 are enlarged views of a control portion between a drum and a charging bias, wherein (a) shows a state in which fine particles are accumulated at the control portion, and (b) shows a state in which the accumulated fine particles pass through the charging bias.

Figure 10:
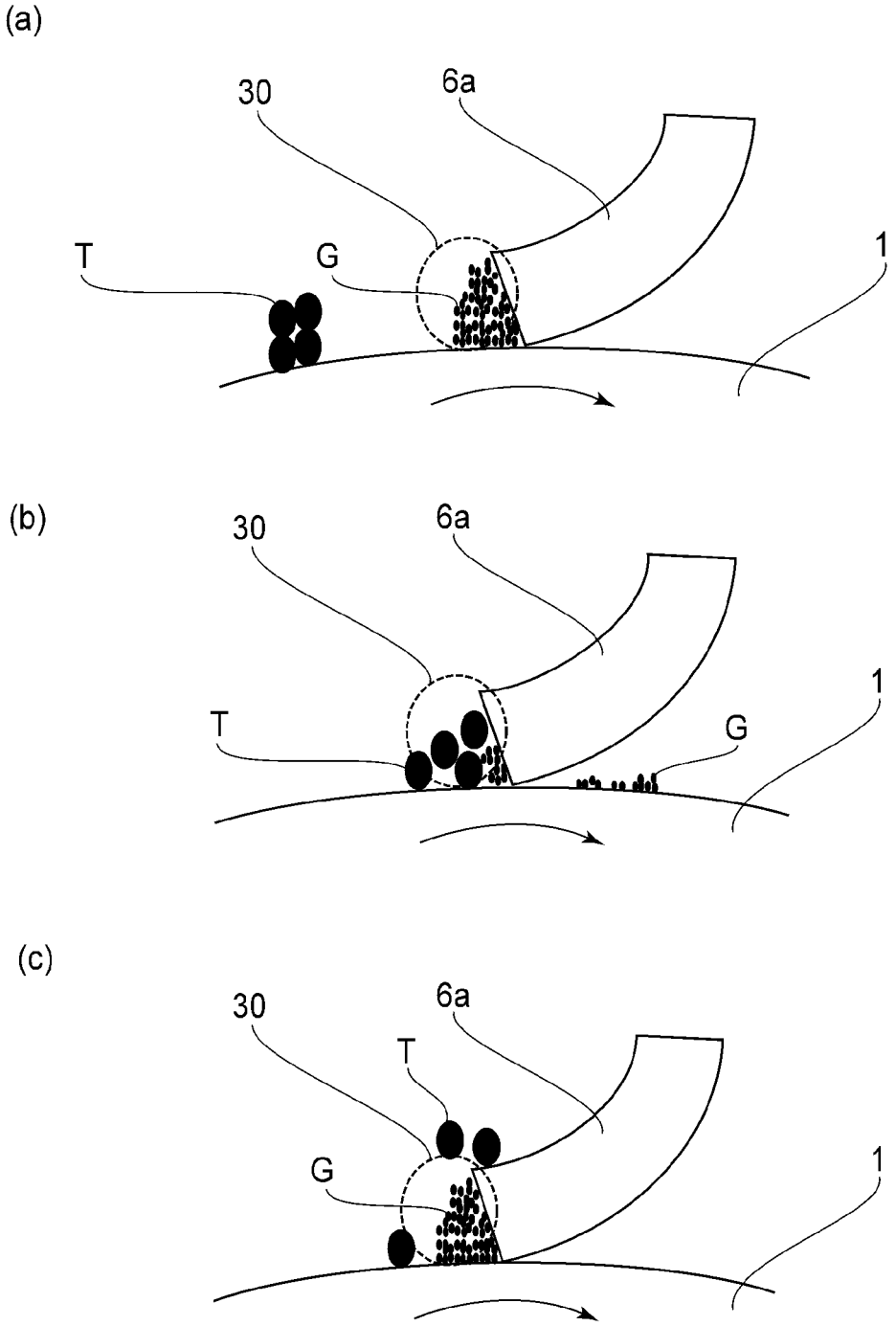

Parts (a), (b) and (c) of FIG. 10 are enlarged views of the control portion between the drum and the charging bias, wherein (a) shows the case where a toner T is carried to the neighborhood of the control portion between the drum and the charging bias, (b) shows the case where the carried toner T is charged to the positive polarity, and (c) shows the case where the carried toner T is charged to the negative polarity.

DESCRIPTION OF THE PREFERRED EMBODIMENTS

Hereinbelow, preferred embodiments of the present invention will be exemplarily and specifically described with reference to the drawings. However, dimensions, materials, shapes, relative arrangements and the like of constituent elements described in the following embodiments are appropriately changed depending on constitutions or various conditions of apparatuses to which the present invention is applied and thus the scope of the present invention is not limited thereto.

Embodiment 1

(1) General Structure of Image Forming Apparatus

Figure 1:
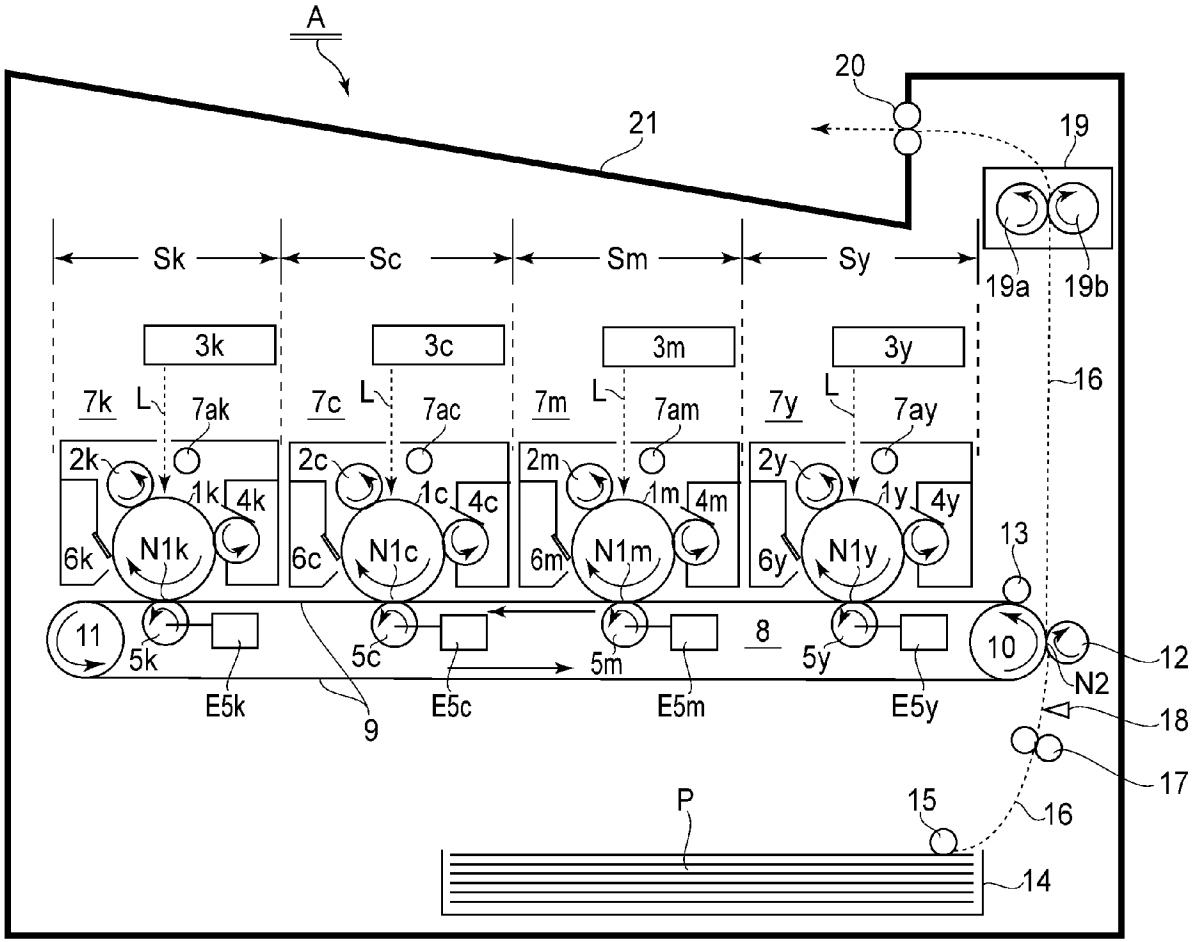
FIG. 1 is a schematic illustration of an image forming apparatus (of an intermediary transfer type) in Embodiment 1.
Figure 2:
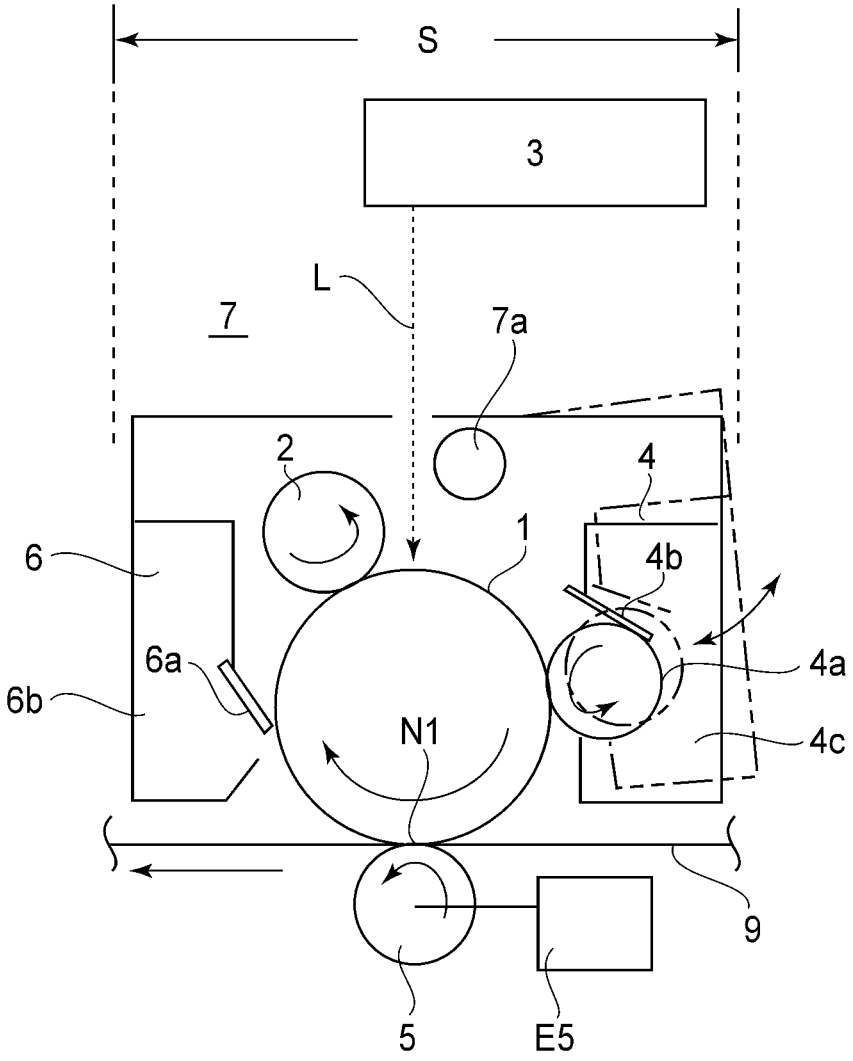
FIG. 2 is an enlarged view of one image forming portion.
Figure 3:
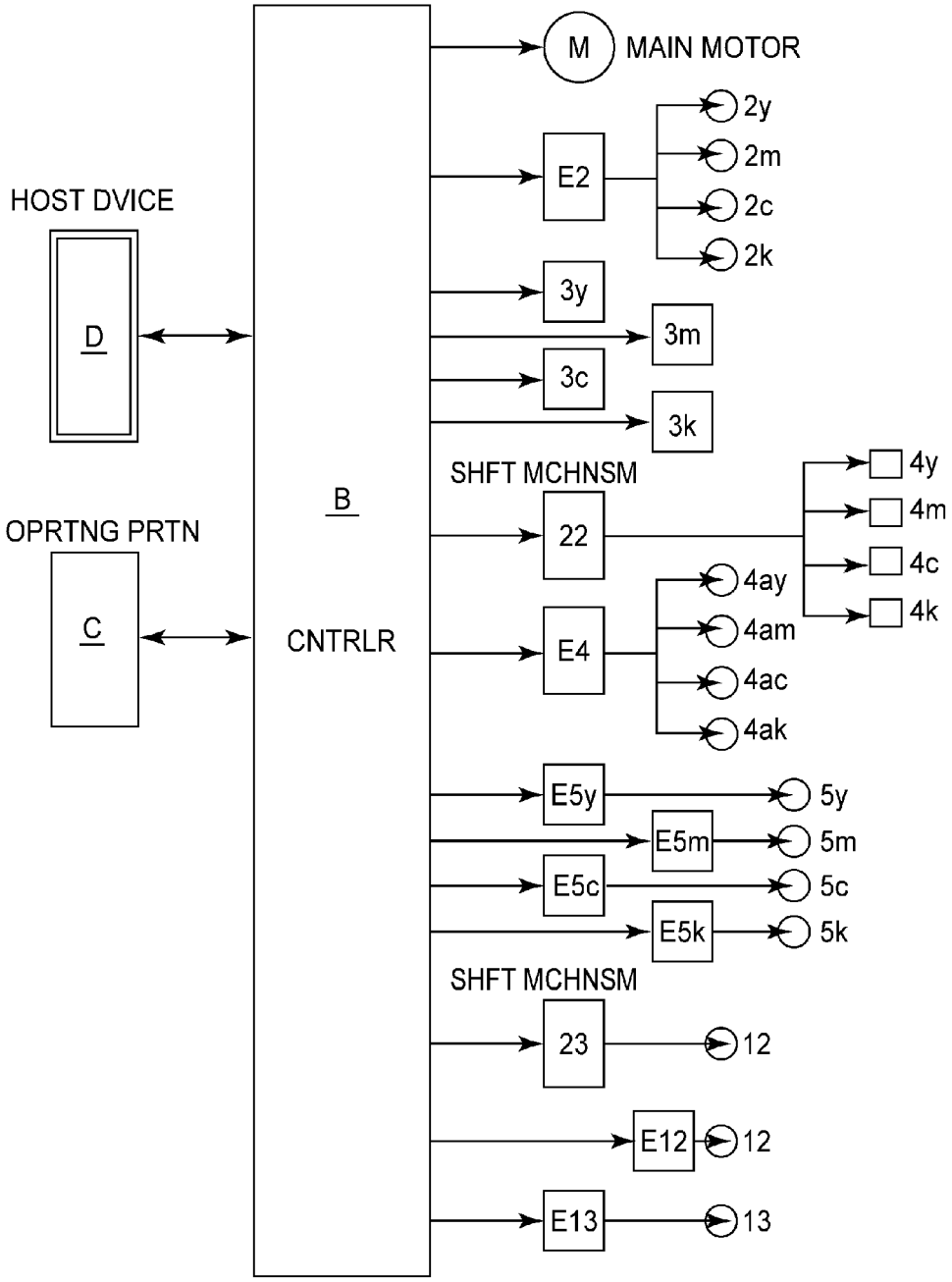
FIG. 3 is a block diagram of a control system.

FIG. 1 is a schematic illustration of an image forming apparatus A in this embodiment. FIG. 2 is an enlarged view of one image forming apparatus in FIG. 1, and FIG. 3 is a block diagram of a control system. The apparatus A is an electrophotographic color laser beam printer of an intermediary transfer type and of an in-line type. The image forming apparatus A is capable of executing, by mode selection, an operation in a multi-color image forming mode in which a plurality of color images are formed on a recording material P on the basis of electrical image information inputted from a host device D (FIG. 3) into a control circuit portion (control means) B and an operation in a single-color image forming mode in which a single-color image is formed. The recording material P is recording media (printing medium) capable of forming the toner image thereon and is a sheet-like member such as plain paper, glossy paper or an OHP (overhead projector) sheet.

The host device D is an image reading device (image reader), a personal computer (PC), a terminal on the network, a remote facsimile machine, a word processor or the like and is connected to the control circuit portion B via an interface portion. The control circuit portion B and effects transfer of various pieces of electrical information between itself and the host device D or an operating portion (control panel) C including a display portion or the like. Further, the control circuit portion B monitors and controls operations of various devices in the apparatus A, thus controlling a print operation (image forming operation) of the apparatus A in a centralized manner in accordance with a predetermined control program or a predetermined reference table.

In the apparatus A, a plurality of image forming portions for forming developer images different in color on image bearing members. In this embodiment, first to fourth (four) image forming portions (hereinafter referred to as stations) S (Sy, Sm, Sc, Sk) are juxtaposed in a horizontal direction from right to left on the drawing sheet in this embodiment and form respective color developer images by parallel processing. The respective stations Sa, Sb, Sc and Sd are electrophotographic image forming mechanisms having the same constitution except that the colors of developers (toners) accommodated in associated developing devices are yellow (Y), magenta (M), cyan (C) and black (K), respectively, which are different from each other.

Here, the constitution and an operation are common to the first to fourth stations with respect to many portions. Therefore, in the following description, in the case where there is no need to particularly differentiate the stations, suffixes y (yellow, m (magenta), c (cyan) and k (black) which indicate elements (portions) provided for associated colors are omitted and will be collectively described. The respective stations S include rotatable drum-type electrophotographic photosensitive members (drums) 1, as image bearing members, on which toner images of different colors of Y, M, C and K in this embodiment are to be formed. Each drum 1 in this embodiment a negatively chargeable lamination type photosensitive layer consisting of lamination of a charge generation layer containing a charge-generating substance on an outer peripheral surface of a drum support and a charge transport layer (surface layer: CT layer) containing a charge-transporting substance on the charge generation layer.

All the drums 1 of the respective stations S are rotationally driven ("ON") in the clockwise direction indicated by arrows at a predetermined speed of 100 mm/sec in this embodiment by turning on a driving means M (main motor: FIG. 3) controlled by the control circuit portion B. By turning off the motor M, the rotation of all the drums 1 is stopped ("OFF").

Around the drum 1, as image forming process means acting on the drum 1, a charging means 2, an image exposure means 3, a developing means 4, a primary transfer means (first transfer means) 5 and a drum cleaning means 6 are provided.

The charging means 2 is a means for uniformly charging a surface of the drum 1 to a predetermined polarity and potential. In this embodiment, a charging roller is used. The charging rollers 2 (2*y*, 2*m*, 2*c*, 2*k*) are an electroconductive roller prepared by providing an electroconductive rubber layer on a core metal, and are provided in contact and parallel to the drums 1 with predetermined pressure, thus being rotated by the rotation of the drums 1.

To the core metal of the charging roller 2 of each station S, a predetermined charging bias is applied with predetermined timing from a charging bias power source E2 as a common charging bias applying means controlled by the control circuit portion B. When the power source E2 is turned on, the charging bias having the negative polarity and predetermined potential is applied to all the charging rollers 2 of the respective stations S. As a result, the peripheral surfaces of all the rotating drums 1 of the respective stations S are uniformly charged to a predetermined potential (dark-portion potential) VD of the negative polarity by generation of electric discharge between each charging roller 2 and each drum 1. The image exposure means 3 is a means for scanning-exposing the charged surface of the drum 1 to light which is modulated depending on the image information. In this embodiment, a laser scanner unit controlled by the control circuit portion B is used. The scanner 3 outputs a laser beam L modulated depending on the image information (electric digital image signal) inputted from the host device D into the control circuit portion B, thus scanning-exposing the charged surface of the drum 1 to the laser beam L. As a result, the exposure portion potential on the drum surface is attenuated to a light-portion potential VL and an electrostatic contrast between the light-portion potential VL and the dark-portion potential VD, latent image corresponding to the image exposure is formed on the drum surface. The developing means 4 is a means for visualizing the electrostatic latent image (electrostatic image) formed on the surface of the drum 1 as a developer image (toner image) with the developer (toner) charged to the normal charge polarity. In this embodiment, the developing means 4 is a reverse developing device of a contact developing type in which non-magnetic one-component negative toner (negatively chargeable toner) is used as the developer. The normal charge polarity of the toner is the charge polarity of the developer used for developing the electrostatic latent image and is negative (−) in this embodiment. This developing device 4 includes a developing roller 4*a* as a developer carrying member which carries the toner and which is contacted to the drum 1, a developer regulating member 4*b* for providing electric charge to the toner to be uniformly coated in a thin layer on the developing roller 4*a*, a developer accommodating chamber (hopper portion) 4*c* which accommodates the toner, and the like.

The developing roller 4*a* is constituted by an elastic rubber material or the like and is rotationally driven, so that the toner is coated in the thin layer on the peripheral surface of the developing roller 4*a*. The developing roller 4*a* is contacted to the drum 1, and a predetermined developing bias is applied to the developing roller 4*a* with predetermined timing from a developing bias power source E4 controlled by the control circuit portion B. As a result, the toner is deposited on the portion of the drum 1 with the dark-portion potential DL, so that the electrostatic latent image is developed as a toner image.

In the developing device 4*y* of the station Sy, the toner of yellow (Y) is accommodated, and a yellow (Y) toner image is formed on the drum 1*y*. In the developing device 4*m* of the second station Sm, the toner of magenta (M) is accommodated, and a magenta (M) toner image is formed on the drum 1*m*. In the developing device 4*c* of the third station Sc, the toner of cyan (C) is accommodated, and a cyan (C) toner image is formed on the drum 1*c*. In the developing device 4*k* of the fourth station Sk, the toner of black (K) is accommodated, and a black (K) toner image is formed on the drum 1*k*.

The primary transfer means 5 is a primary transfer roller (electroconductive roller) in this embodiment and is provided correspondingly to the lower surface of an intermediary transfer belt 9 of an intermediary transfer unit 8 described later. Further, the belt 9 is contacted to the lower surface of the drum 1 to form a primary transfer nip N1. To the respective primary transfer rollers 5, a predetermined primary transfer bias is applied with predetermined timing from primary transfer power sources E5 (E5*y*, E5*m*, E5*c* and E5*k*) as a plurality of corresponding transfer bias applying means controlled by the control circuit portion B. As a result, the toner images on the drums 1 are primary-transferred onto the surface of the belt 9.

Each primary transfer bias power source E5 is a power source also capable of switching the bias applied to the primary transfer roller 5 to a non-collection bias, for preventing a secondary transfer residual toner on the belt 9 from being collected by the drum, in the operation in the monochromatic mode described later.

The cleaning means 6 is a blade cleaning device and removes the primary transfer residual toner or the like on the drum 1 with a cleaning blade 6*a* to clean the drum 1. The blade 6*a* is counterdirectionally contacted to the drum 1 with a contact pressure of 70 gf/cm. Further, an end of the blade 6*a* is penetrated into the developing roller 1 by about 1 mm at an angle of 30 degrees with respect to the tangential line at its contact portion with the drum 1. The primary transfer residual toner or the like on the drum 1 is scraped off by the end of the blade 6*a* and is accommodated in a residual toner container 6*b*.

Here, the apparatus A in this embodiment includes process cartridges 7 (7*y*, 7*m*, 7*c*, 7*k*) each prepared by integrally assembling the drum 1, the charging roller 2, the developing device 4 and the cleaning device 6 so as to be detachably mountable to the apparatus main assembly in the associated station S. The cartridge 7 in this embodiment includes a drum unit prepared by assembling the drum 1, the charging roller 2 and the cleaning device with a common frame and a developing unit, assembled with the drum unit, in which the developing device 4 is swingable about a supporting shaft 7*a*.

In the cartridge 7, in a state in which it is mounted at a mounting portion of the apparatus main assembly, the drum unit is positioned and fixed to the apparatus main assembly an urging mechanism (not shown) in the apparatus main assembly side. Correspondingly, to the developing device 4, a shift mechanism 22 (FIG. 3) such as a cam mechanism or the like is provided in the apparatus main assembly side. The shift mechanism 22 is controlled by the control circuit portion B to be selectively changed in state to a non-acting state on the developing device 4 in each station S.

When the shift mechanism 22 is changed to the non-acting state, the developing device 4 is rotationally moved toward the drum unit about the shaft 7*a* by an urging spring (not shown), so that the developing roller 4*a* is shifted to a developing position where it is abutted against the drum 1 with predetermined pressure and is thus held (as indicated by a solid line of FIG. 2). The developing roller 4*a* is rotationally driven in the state in which the developing device 4 is shifted to the developing position, and the developing bias is applied to the developing roller 4*a*.

Further, when the shift mechanism is changed to the acting develop (state), the developing device 4 is rotationally moved apart from the drum unit about the shaft 7*a* against the urging spring, so that the developing roller 4*a* is shifted to a non-development position where it is spaced from the drum 1 and is thus held (as indicated by a chain double-dashed line of FIG. 2). Rotation of the developing roller 5*a* is stopped in a state in which the developing device 4 is shifted to the non-development position, and the developing bias is not applied to the developing roller 4*a*.

At a lower portion of the four (first to fourth) stations Sy, Sm, Sc and Sk, the intermediary transfer unit 8 is provided. The unit 8 includes a flexible endless intermediary transfer belt (endless belt-like film) 9 as the intermediary transfer member which is circulated and moved to be subjected to the transfer of the toner image from each station S. The belt 9 in this embodiment has a volume resistivity of about $3\times10^{10}$ Ω·cm in an environment of 23° C./50% RH.

The belt 9 is stretched between a driving roller 10 and an opposite roller 11, provided in parallel to the driving roller 10, which are used as a plurality of supporting members (belt stretching members). The driving roller 10 is provided in the first station Sy side. The opposite roller 11 is provided in the fourth station Sk side. An upper belt portion between the driving roller 10 and the opposite roller 11 extends at the lower portion of the first to fourth stations Sy, Sm, Sc and Sk.

The driving roller 10 is driven in the counterclockwise direction indicated by an arrow by a belt driving portion (not shown) to which a driving force of the motor M is transmitted. The driving roller 10 is driven, so that the belt 9 is rotated in the counterclockwise direction indicated by an arrows. The belt 9 is rotated in the same direction as those of the drums 1 at the same speed of 100 mm/sec as those of the photosensitive members 1. The opposite roller 11 is rotated by the rotation of the belt 9. The primary transfer roller 5 of each station S is provided inside the belt 9 and is contacted to the belt 9 at the lower portion of the drum 1. The contact portion between the belt and the drum 1 is the primary transfer nip N1. The primary transfer roller 5 is rotated by the rotation of the belt 9.

In this embodiment, of the four (first to fourth) stations, Sy, Sm, Sc and Sk, the first station Sy is an upstreammost station with respect to a movement direction of the belt 9, and the fourth station Sk is a downstreammost station with respect to the movement direction.

Figure 4:
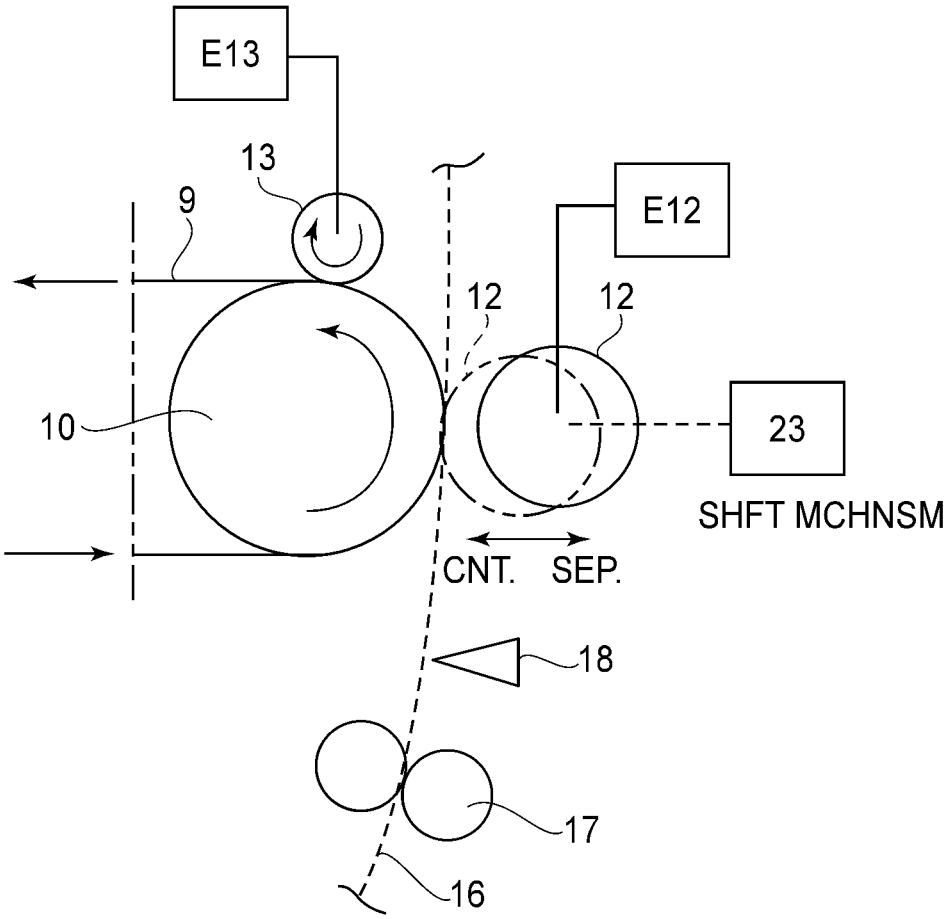
FIG. 4 is an enlarged view of a secondary transfer roller portion.

At a belt stretching portion of the driving roller 10, a secondary transfer roller (second transfer means) 12 as a secondary transfer means is provided. The roller 12 is an electroconductive roller of which surface layer portion is formed of an elastic material. The position of the roller 12 is changed, by a shift mechanism 23 (FIG. 3) such as a solenoid or a cam mechanism controlled by the control circuit portion B, between a contact position where the roller 21 is press-contacted to the belt 9 toward the driving roller 10 with predetermined pressure and a non-contact position where the roller 12 is separated from the belt 9 as shown in FIG. 4. The contact portion between the belt 9 and the roller 12 changed in position to the contact position is a secondary transfer nip N2.

The roller 12 is rotated by the rotation of the belt 9 in the state in which it is changed in position to the contact position. Further, to the roller 12, a predetermined secondary transfer bias is applied with predetermined control timing from a secondary transfer bias power source E12 controlled by the control circuit portion B.

Further, with respect to the movement direction of the belt 9, a belt cleaning roller 13 is provided, in contact to the belt 9, downstream of the secondary transfer roller 12 and upstream of the first station Sy which is provided in the upstreammost side of the plurality of stations. The roller 13 is a means for effecting pre-process for collecting the secondary transfer residual toner and the like on the belt 9 by the drum 1 of the station S. More specifically, the roller 13 is a developer charging means for charging the toner deposited on the belt 9 to the opposite polarity (positive) to the normal charge polarity (negative).

The roller 13 is rotated by the rotation of the belt 9. Further, to the roller 13, a predetermined cleaning bias is applied with predetermined control timing from a cleaning bias power source E13 controlled by the control circuit portion B.

Below the unit 8, a recording material cassette 14 in which sheets of the recording material P are stacked and accommodated is detachably mounted in the apparatus main assembly. The recording material P accommodated in the cassette 14 is pulled one by one by rotation of a recording material feeding roller 15 controlled by the control circuit portion B and then is guided into a sheet path 16 extending in the vertical direction. The recording material P is guided into the secondary transfer nip N2 with predetermined control timing by a timing roller pair 17 and a timing sensor 18, thus being nip-conveyed. As a result, the toner images formed on the surface of the belt 9 are successively secondary-transferred onto the surface of the recording material P.

Above the secondary transfer roller 12, a fixing device 19 is provided. The fixing device 19 includes a rotatable fixing roller 19*a* to be heated by a halogen lamp heater (not shown) incorporated in the fixing roller 19*a* and a pressing roller 19*b* press-contacted to the fixing roller 19*a* to form a fixing nip. The recording material P is guided and nip-conveyed in the fixing nip of the fixing device 19. As a result, an unfixed toner image on the recording material P is fixed as a fixed image. The recording material P coming out of the fixing device 19 is discharged, as an image-formed product, onto a discharge tray 21 by a discharging roller pair 20.

(2) Multi-Color Image Forming Mode (Full-Color Mode)

Figure 5:
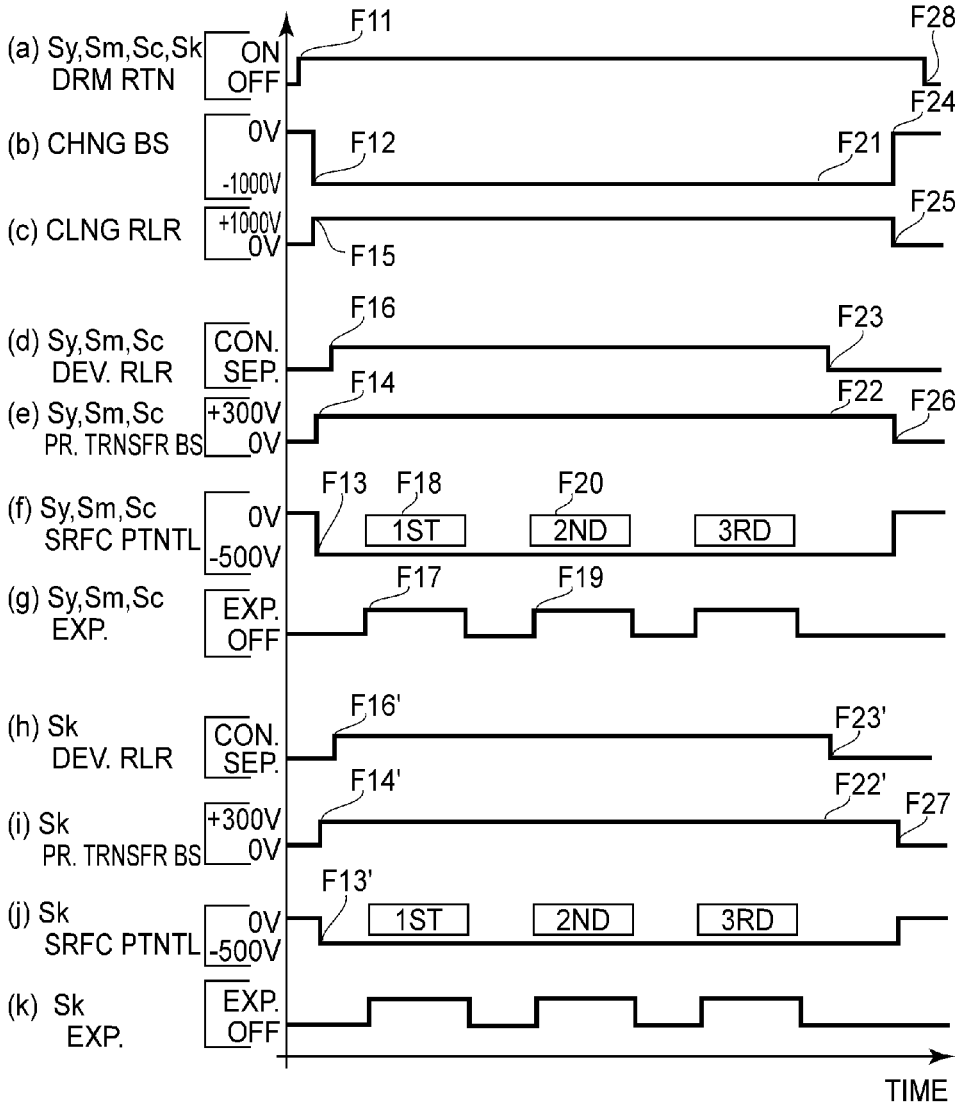
FIG. 5 is a control timing chart of an apparatus operation in a full-color mode (multi-color image forming mode).

Here, the case where a full-color output image is continuously formed on 3 sheets of the recording material by using all the first to fourth stations Sy, Sm, Sc and Sk will be described as an example. FIG. 5 is a timing chart of an image forming operation in a full-color mode performed by the control circuit portion B in this case. The abscissa represents a time. In FIG. 5, the same region of the drum 1 is vertically aligned.

At (a), (b) and (c) of FIG. 5, relations among rotation and rotation stop of the drum 1, output and output stop of the charging bias to the charging roller 2 and output and output stop of the cleaning bias to the cleaning roller 13 in all the stations, Sy, Sm, Sc and Sk are shown.

At (d), (e), (f) and (g) of FIG. 5, relations among contact and separation operations of the developing rollers 4*ay*, 4*am* and 4*ac*, output and output stop of the primary transfer bias, the surface potential of the drum 1 and the image exposure operation in the first to third stations Sy for Y, Sm for M and Sc for C are shown.

At (h), (i), (j) and (k) of FIG. 5, relations among the contact and separation operation of the developing roller 4*ak*, the output and output stop of the primary transfer bias, the surface potential of the drum 1 and the image exposure operation in the fourth station Sk for K.

1) When the control circuit portion B receives a print request of an operation in the full-color mode from the host device D or the operating portion C, the control circuit portion B actuates the main motor M to start rotation of the drum 1 in each of the stations S (F11). That is, the drums 1 of all the stations S are driven. By the actuation of the main motor M, the driving roller 10 is driven and the belt 9 is also rotationally driven.

2) When the secondary transfer roller 12 is located at a separation position, the control circuit portion B controls the shift mechanism 23 so that the position of the secondary transfer roller 12 is changed to the contact position. A charging bias of −1000 V is applied from the charging bias power source E2 to the charging roller 2 (F12). As a result, the surface of the drum 1 is uniformly charged to the dark-portion potential VD=−500 V (F13, F13').

Together with this charging bias application, the primary transfer bias of +300 V is applied from the primary transfer bias power source E5 to the primary transfer roller 5 (F14, F14'). Further, the cleaning bias of +1000 V is applied from the cleaning bias power source E13 to the cleaning roller 13 (FIG. 15).

3) Next, the developing devices 4 in all the stations S are moved to the development position by the shift mechanism 22, so that the developing rollers 4*a* are contacted to the drums 1 (F16, F16'). Thereafter, first, the exposure depending on the image information is effected by the scanner 3*y* in the first station Sy for Y (yellow) (F17), so that the electrostatic latent image is formed on the surface of the drum 1*y* (F18). The surface potential of the drum 1*y* after the electrostatic latent image is formed is the light-portion potential VL=−100 V.

The electrostatic latent image formed on the drum 1*y* is developed by the developing roller 4*ay* to form a Y toner image, and then the Y toner image is primary-transferred onto the belt 9 by the primary transfer bias of +300 V applied to the primary transfer roller 5*y* in the primary transfer nip N1*y*.

4) In a similar manner, an M (magenta) toner image is formed on the drum 1*m* in the second station Sm for M and then is superposedly transferred onto the Y toner image, which has already been transferred on the belt 9, in the primary transfer nip N1*m*. Further, a C (cyan) toner image is formed on the drum 1*c* in the third station Sc for C and then is superposedly transferred onto the Y and M toner images, which have already been transferred on the belt 9, in the primary transfer nip N1*c*.

Finally, a K (black) toner image is formed on the drum 1*k* in the fourth station Sk for K and then is superposedly transferred onto the Y, M and C toner images, which have already been transferred on the belt 9, in the primary transfer nip N1*k*.

In each station S, the primary transfer residual toner remaining on the drum 1 after the primary transfer of the toner image onto the belt 9 is scraped off from the drum surface by the cleaning blade 6*a* of the cleaning device 6, thus being stored in a residual toner container 6*b*.

Thus, a full-color unfixed toner image based on the four colors of Y, M, C and K is synthetically formed. Here, in the apparatus A in this embodiment, the color toner images Y, M, C and K are successively primary-transferred superposedly onto the belt 9 in this order. However, the order may appropriately be changed. Further, it is also possible to employ an apparatus constitution in which stations for two colors, three colors or five or more colors are provided.

5) On the other hand, the recording material feeding roller 15 is driven with predetermined control timing to feed the recording material P from the cassette 14 and sends the recording material P to the timing roller pair 17. In this case, the recording material P is detected by a timing sensor 18 provided in an exit side of the roller pair 17 and on the basis of the detection, the roller pair 17 is once stopped, so that the recording material P is in stand-by at its position.

Then, with timing when the toner images on the belt 9 reach the secondary transfer nip N2 by the rotation of the belt 9, the rotation of the roller pair 17 is resumed to send the recording material P into the nip N2. Further, to the secondary transfer roller 12, the predetermined secondary transfer bias is applied with predetermined control timing from the secondary transfer bias power source E12. As a result, the color toner images are successively secondary-transferred from the belt 9 onto the recording material P by the nip-conveyance of the recording material P in the nip N2.

6) The recording material P coming out of the nip N2 is separated from the belt 9 and is guided into the fixing nip of the fixing device 19, thus being nip-conveyed. As a result, the unfixed toner image on the recording material P is fixed as the fixed image. The recording material P coming out of the fixing device 19 is discharged as the full-color image-formed product on the discharge tray 21 by the discharging roller pair 20.

7) In the station Sy for Y where the image forming operation on the first sheet is ended, the exposure depending on the image information on the second sheet is effected by the scanner 3*y* (F19), so that the electrostatic latent image is formed (F20). Thereafter, the electrostatic latent image is developed by the developing device 4*y* to form the Y toner image and then the Y toner image is primary-transferred onto the belt 9 by the primary transfer roller 5*y*. At this time, the secondary transfer residual toner or the like on the belt 9 is positively charged by applying the cleaning bias of +1000 V to the cleaning roller 13.

Therefore, simultaneously with the primary transfer of the Y toner image for the second sheet, the second transfer residual toner on the belt 9 during the image formation on the first sheet is collected by the drum 1*y*. The collected secondary transfer residual toner is collected in the cleaning device 6*y*.

In a similar manner, in the respective stations Sm for M, Sc for C and Sk for K, the toner images corresponding to the associated colors are formed, respectively, and are successively primary-transferred superposedly onto the belt 9. Thus, the full-color toner image for the second sheet is formed on the belt 9 and then reaches the nip N2 by further rotational movement of the belt 9, so that the toner image is secondary-transferred onto the second sheet of the recording material P. Then, similarly as in the case of the first sheet of the recording material P, the recording material P is guided into the fixing device 19 and then is discharged onto the discharge tray 21.

8) By repeating such an operation, the full-color output image for the third sheet is formed. In each station S after the full-color toner image for the final third sheet is primary-transferred, the charging bias (F21) and the primary transfer bias (F21, F21') which are the same as those during the image formation are applied as they are. Then, all the developing rollers 4*a* are separated from the drums 1 (F23, F23'), and then collection of the secondary transfer residual toner for the full-color toner image for the final third sheet is effected. Thereafter, all the biases are turned off (F24, F25, F26, F27).

Thereafter, the main motor M is turned off. As a result, the rotation of all the drums 1 and the belt 9 is stopped (F28), so that the image forming apparatus A is ready for a subsequent print request.

(3) Single-Color Image Forming Mode (Monochromatic Mode)

Figure 6:
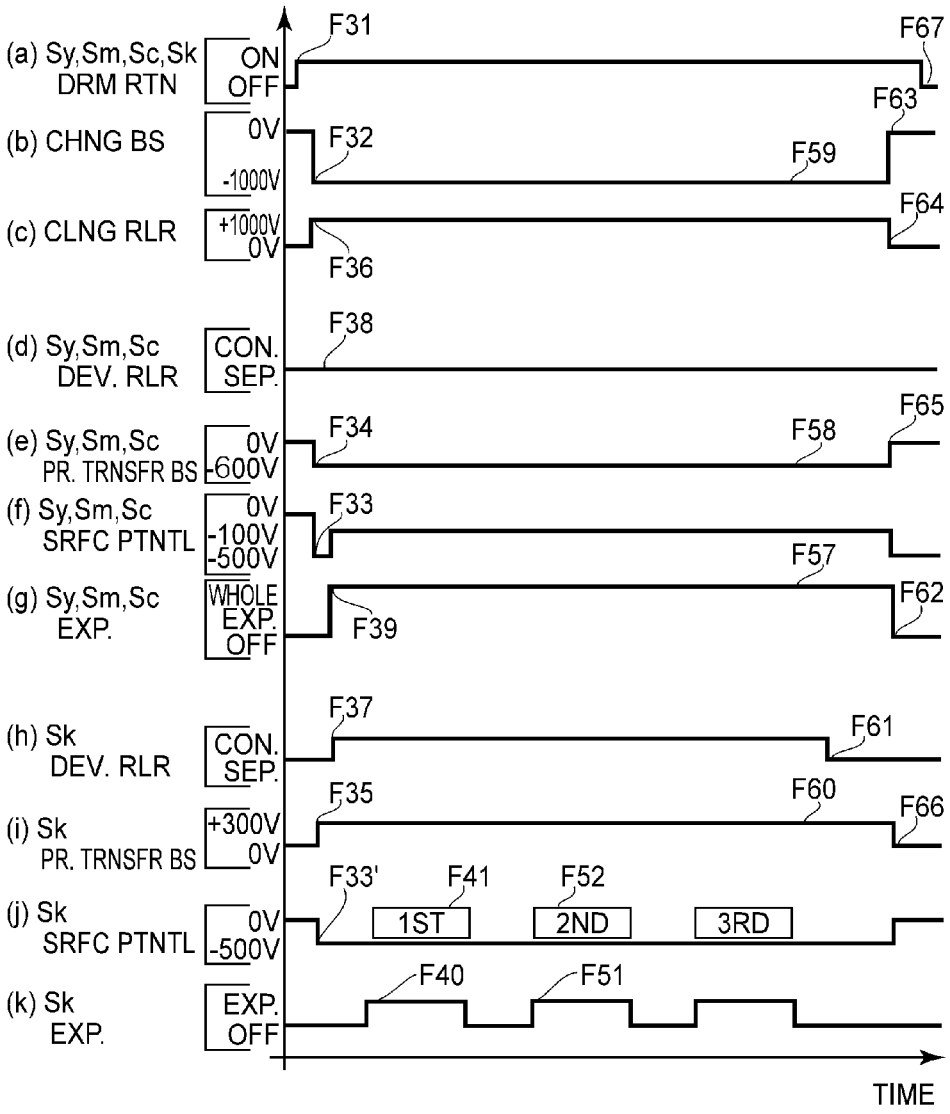
FIG. 6 is a control timing chart of an apparatus operation in a monochromatic mode (single-color image forming mode).

In the operation in the single-color image forming mode, the image formation is effected by using only one of the first to fourth stations Sy, Sm, Sc and Sk. Here, the case where the black output image is continuously formed on three sheets by using only the fourth station Sk for K will be described as an example. FIG. 6 is a timing chart of an image forming operation in the monochromatic mode performed by the control circuit portion B. The abscissa represents the time. In FIG. 6, the same region of the drum 1 is vertically aligned.

At (a), (b) and (c) of FIG. 6, relations among rotation and rotation stop of the drum 1, output and output stop of the charging bias to the charging roller 2 and output and output stop of the cleaning bias to the cleaning roller 13 in all the stations, Sy, Sm, Sc and Sk are shown.

At (d), (e), (f) and (g) of FIG. 6, relations among contact and separation operations of the developing rollers 4*ay*, 4*am* and 4*ac*, output and output stop of the primary transfer bias, the surface potential of the drum 1 and the image exposure operation in the first to third stations Sy for Y, Sm for M and Sc for C are shown.

At (h), (i), (j) and (k) of FIG. 6, relations among the contact and separation operation of the developing roller 4*ak*, the output and output stop of the primary transfer bias, the surface potential of the drum 1 and the image exposure operation in the fourth station Sk for K.

1) First, when the control circuit portion B receives a print request of an operation in the monochromatic mode from the host device D or the operating portion C, the control circuit portion B actuates the main motor M to start rotation of the drum 1 in each of the stations S (F31). That is, the drums 1 of all the stations S are driven. By the actuation of the main motor M, the driving roller 10 is driven and the belt 9 is also rotationally driven.

Further, when the secondary transfer roller 12 is located at a separation position, the control circuit portion B controls the shift mechanism 23 so that the position of the secondary transfer roller 12 is changed to the contact position.

2) A charging bias of −1000 V is applied from the charging bias power source E2 to the charging roller 2 (F32). As a result, the surface of the drum 1 is uniformly charged to the dark-portion potential VD=−500 V (F33, F33').

Together with this charging bias application, a non-collection bias of −600 V is applied to the primary transfer rollers 5*y*, 5*m* and 5*c* in the first to third stations Sy, Sm and Sc (F34). The primary transfer bias of +300 V is applied to the primary transfer roller 5*k* in the fourth station Sk (F35). Together with this primary transfer bias application, the cleaning bias of +1000 V is applied from the cleaning bias power source E13 to the cleaning roller 13 (F*igure* 36).

3) Next, only the developing devices 4*k* in the fourth station Sk for K is moved to the development position by the shift mechanism 22, so that the developing rollers 4*ak* is contacted to the drum 1*k* (F37). At this time, the developing devices 4*y*, 4*m* and 4*c* in the first to third stations Sy, Sm and Sc for other colors of Y, M and C are held at the non-development position, so that the developing rollers 4*ay*, 4*am* and 4*ac* are prevented from being contacted to the drums 1*y*, 1*m* and 1*c* (F38).

When the developing roller 4*ak* in the fourth station Sk for K is contacted to the drum 1*k*, in other stations Sy, Sm and Sc which are not subjected to the image formation, the whole surface exposure is effected by the scanners 3*y*, 3*m* and 3*c* (F39). Here the whole surface exposure is light exposure for forming the electrostatic latent image for a solid image. That is, by this whole surface exposure, in other stations Sy, Sm and Sc, the surfaces of the drums 1*y*, 1*m* and 1*c* are charge-removed to about −100 V.

By this whole-surface exposure and non-collection bias application, the secondary transfer residual toner charged to the positive polarity by the cleaning roller 13 is not substantially collected in the stations Sy, Sm and Sc other than the station Sk for K. As a result, the secondary transfer residual toner on the belt 9 can be collected in the station Sk for K.

4) Thereafter, the exposure depending on the image information is effected by the scanner 3*k* in the station Sk for K (F40), so that the electrostatic latent image is formed on the surface of the drum 1*k* (F41).

The electrostatic latent image formed on the drum 1*k* is developed by the developing roller 4*ak* to form a K (black) toner image, and then the K toner image is primary-transferred onto the belt 9 in the primary transfer nip N1*k* by the primary transfer bias of +300 V applied to the primary transfer roller 5*k*.

The primary transfer residual toner remaining on the drum lk after the primary transfer of the toner image onto the belt 9 is scraped off from the drum surface by the cleaning blade 6*a* of the cleaning device 6, thus being stored in a residual toner container 6*b*.

Thus, the K toner image formed on the belt 9 is moved toward the secondary transfer nip N2 by the rotational movement of the belt 9. Further, a synchronism with the K toner image sent to the nip N2, the supply of the recording material P toward the nip N2 is started. Further, to the secondary transfer roller 12, the predetermined secondary transfer bias is applied with predetermined control timing from the secondary transfer bias power source E12. As a result, the K toner image is successively secondary-transferred from the belt 9 onto the recording material P by the nip-conveyance of the recording material P in the nip N2.

5) The recording material P coming out of the nip N2 is separated from the belt 9 and is guided into the fixing nip of the fixing device 19, thus being nip-conveyed. As a result, the unfixed toner image on the recording material P is fixed as the fixed image. The recording material P coming out of the fixing device 19 is discharged as the monochromatic image-formed product on the discharge tray 21 by the discharging roller pair 20.

6) Then, the sequence goes to an operation for forming the black image on the second sheet in the station Sk for K. In the station Sk for K, the exposure depending on the image information on the second sheet is effected by the scanner 3*k* (F51), so that the electrostatic latent image is formed on the surface of the drum 1*k* (F52). Thereafter, the electrostatic latent image is developed by the developing roller 4*ak* to form the K toner image and then the K toner image is primary-transferred onto the belt 9 by the primary transfer bias of +300 V applied to the primary transfer roller 5*k* in the primary transfer nip N1*k*.

Here, simultaneously with the transfer of the K toner image from the drum 1*k* onto the belt 9 in the nip N1*k*, the secondary transfer residual toner, during the image formation on the first sheet, positively charged on the belt 9 is collected by the drum 1*k*.

7) Thus, the K toner image for the second sheet formed on the belt 9 is moved toward the secondary transfer nip N2 by the rotational movement of the belt 9, so that the K toner image is secondary-transferred onto the second sheet of the recording material P. Then, the recording material P on which the K toner image is secondary-transferred is passed through the fixing device 19 and then is discharged onto the discharge tray 21.

By repeating such an operation, the K output image for the third sheet is formed. In other stations Sy, Sm and Sc after the K roller toner image for the final third sheet is primary-transferred, the charging bias and the primary transfer bias which are the same as those during the image formation are applied as they are (F57, F58, F59). Further, also in the station Sk for K, the charging bias and the primary transfer bias which are the same as those during the image formation are applied as they are (F59, F60).

Then, the developing device 4K in the station Sk for K is moved to the non-development position, so that the developing roller 4*ak* is separated from the drum 1*k* (F61). Thereafter, the secondary transfer residual toner on the belt 9 during the image formation of the K toner image on the final third sheet is collected in the station Sk for K. Thereafter, the whole surface exposure and all the biases are turned off (F62, F63, F64, F65, F66). Thereafter, the main motor M is turned off. As a result, the rotation of all the drums 1 and the belt 9 is stopped (F67), so that the image forming apparatus A is ready for a subsequent print request.

(4) Mechanism of Occurrence of Charging Roller Period Lateral White Stripe

First, a charging roller period lateral white stripe generated in this embodiment will be described. Parts (a) and (b) of FIG. 9 are enlarged views of the contact portion between the drum 1 and the cleaning blade 6*a*.

As described above, also in the monochromatic mode, all the drums 1 in the stations S are rotationally driven. For that reason, the drums 1 in the stations Sm, Sy and Sc which are not subjected to the image formation cause the generation of the abrasion thereof by the friction with a member contacted thereto such as the cleaning blade 6*a*.

Powder of the abraded photosensitive member (hereinafter referred to as abrasion powder) is gradually accumulated in a wedge-like region 30 between the photosensitive member and the charging bias of the cleaning device. When the operation in the monochromatic mode is continued, in the region 30, a phenomenon G such that fine particles such as the abrasion powder and other fine particles are gradually accumulated in a large amount is generated ((a) of FIG. 9). The accumulated fine particles G such as the abrasion power can pass through the charging bias at the same time in a state such that distortion drastically occurs at an end of the charging bias ((b) of FIG. 9). The state such that distortion drastically occurs at an end of the charging bias is, e.g., such that drive of the photosensitive member is resumed from a state in which the photosensitive member is stopped. The fine particles passing through the charging bias are deposited on the charging roller, thus causing a lateral stripe-like contamination of the charging roller. Incidentally, these fine particles G are deposited on the charging roller to which the bias of the negative polarity is to be applied and therefore it would be considered that the fine particles have a positive charging series.

When the charging roller is contaminated with the fine particles G such as the photosensitive member abrasion powder (hereinafter referred to as positive fine particles), the charging of the photosensitive member (photosensitive drum) by the charging roller becomes non-uniform. Therefore, at other color image forming stations, when the image was outputted in the operation in the full-color mode after many images were formed in the operation in the monochromatic mode, a lateral white stripe was generated with a period (cycle) of the charging roller in some cases.

In this embodiment, the charging bias power source for applying the charging bias to the charging device are common to the four image forming stations, so that the single charging bias power source is used in the four image forming stations. In that case, also during the image formation in the operation in the monochromatic mode, the charging bias is applied to all the image forming stations. Then, by providing such commonality of the power source, the image forming apparatus can be downsized.

Further, in this embodiment, in order to remove the secondary transfer residual toner remaining on the intermediary transfer member surface after the secondary transfer, the cleaning roller 13 (developer charging means) for charging the developer is provided. By the cleaning roller 13, the secondary transfer residual toner is charged to the opposite polarity to the normal charge polarity of the toner. Thereafter, simultaneously with the primary transfer of the toner image from the photosensitive member surface onto the intermediary transfer member, the secondary transfer residual toner charged to the opposite polarity is returned to the photosensitive member and is collected by the photosensitive member cleaning device.

In such an image forming apparatus in which the commonality of the charging bias power source is provided and the secondary transfer residual toner is returned to the photosensitive member and then is collected by the photosensitive member cleaning device, particularly there is a tendency to increase a degree of the abrasion of the drum 1. The reason thereof will be described below.

In the operation in the monochromatic mode, only the formation of the black image is effected and therefore the collection of the secondary transfer residual toner using the developer charging means is effected in only the image forming station for black. This is because when the collection of the secondary transfer residual toner is also effected in the image forming stations for other colors, the residual toner is accumulated in the cleaning devices in the image forming stations for other colors although the image formation is effected in only the image forming station for black.

Particularly, in the case where the process cartridges are provided, although only the black toner is consumed in the operation in the monochromatic mode, there arises a situation such that the process cartridge for another color (e.g., yellow) is required to be replaced.

For this reason, in the image forming stations for other colors during the operation in the monochromatic mode, in order to prevent the secondary transfer residual toner from being collected, as the primary transfer bias, the primary transfer bias of the opposite polarity to that during the normal image formation is applied. For example, in the image forming apparatus in which the reverse development is effected by using the negative toner, the positive bias is applied during the normal image formation. Further, during the operation in the monochromatic mode, the negative bias is applied in order to prevent the secondary transfer residual toner from being collected. This is because the secondary transfer residual toner is charged to the positive polarity by the developer charging means.

In addition, in the image forming stations for other colors in the operation in the monochromatic mode, the photosensitive member surfaces are subjected to the whole surface exposure to be charge-removed, thus having a weakly negative polarity. As described above, the whole surface exposure is the exposure for forming the electrostatic latent image for the solid image.

This is because as described above, in the case where only the single charging bias power source is provided, the photosensitive member surfaces are negatively charged in the image forming stations for other colors also in the operation in the monochromatic mode. The secondary transfer residual toner of the positive polarity is prevented from being collected to the possible extent by effecting the whole surface exposure and by providing the photosensitive member (drum) surfaces with the weakly negative polarity.

Thus, by effecting the application of the negative primary transfer bias and the whole surface exposure, the secondary transfer residual toner can be collected in the image forming station for black in the operation in the monochromatic mode without being substantially collected in the image forming stations for other colors.

However, in such a system, in the image forming stations for other colors in the operation in the monochromatic mode, the charging bias is applied continuously and the whole surface exposure is also effected and therefore electric discharge by the charging device is always repeated. Therefore, by the discharge, the photosensitive member is abraded or worn. In addition, the collection of the secondary transfer toner or the like is not effected and therefore in the cleaning device, the abrasion powder of the photosensitive member is gradually accumulated in a large amount.

(5) Suppressing Means of Charging Roller Period Lateral White Stripe

Next, as a characteristic feature in this embodiment, a means for suppressing the charging roller period lateral white stripe will be described. As described above, in the case where printing is performed on a large number of sheets in the operation in the monochromatic mode, the positive fine particles principally comprising the abrasion powder are accumulated at end portions of the charging bias in the stations which are not subjected to the image formation. The characteristic feature of this embodiment is such that the toner is supplied to the end portions of the cleaning blade 6*a* with reliability to pass the positive fine particles through the charging bias end portions. This method will be described below in detail.

First, the present inventor studied on a discharging efficiency of the positive fine particles accumulated at the cleaning blade 6*a* and a characteristic of the toner supplied to the blade 6*a*. In this study, after a solid image is printed and then the primary transfer bias is applied, when the image is removed at the end portion of the blade 6*a*, the drive of the drum 1 is stopped and then the surface of the drum 1 was observed between the blade 6*a* and the charging roller 2. In this observation, whether or not the positive fine particles were discharged from the end portion of the blade 6*a* was checked.

In this experiment, the drum 1 in a state in which the CT layer of the drum 1 was decreased in thickness of about 0.8 μm from start of use thereof in the operation in the monochromatic mode was used. The amount of the decrease in thickness of the CT layer of the drum 1 is referred to as an abrasion amount. By using such a drum 1, a condition in which the positive fine particles containing the abrasion powder were sufficiently accumulated was provided.

Incidentally, the thickness of the CT layer of the drum 1 was measured by using a film thickness measuring device ("Fischerscope mms", mfd. by Fischer Instruments K.K.). Further, the thickness was measured at an initial stage where the drum 1 was not rotated and after the image forming process was repetitively performed (after durability test). A difference between these thickness was defined as the abrasion amount.

As the toner, the Y toner was used. Further, in the primary transfer, two types of a weakly positive bias and a strongly positive bias were applied. With respect to each of the biases, the bias was adjusted so that a density of the toner remaining on the drum 1 between the end portion of the blade 6*a* and the primary transfer nip N1 after the primary transfer was about 0.15.

The density was measured in the following manner. The transfer residual toner was collected by a transparent polyester tape ("No 550", mfd. by Nichiban Co., Ltd.) and then the tape was applied onto white paper ("Xerox 4200" mfd. by Xerox Corp.). The toner density was measured via the tape by a measuring device ("Macbeth Densitometer", mfd. by Macbeth Corp.).

Under application of the weak bias, the transfer residual toner remains on the drum 1 since the bias is weak and thus the toner (image) after being subjected to the development is not completely transferred onto the belt 9. On the other hand, under application of the strong bias, the transfer residual toner is deposited on the drum 1 as it is without being transferred onto the belt 9 since the bias is excessively strong and thus a part of the toner (image) after being subjected to the development is charged to the positive polarity (opposite to the normal charge polarity of the toner). Therefore, most of the toner on the drum 1 after the primary transfer was negative under the weak bias application but on the other hand, under the strong bias application, the positively charged toner was present in a large amount.

At the time when the transfer residual toner of the solid image enters, from the print start, the end portion of the blade 6*a* by about 20 mm, the drive of the photosensitive member 1 was forcedly stopped and then the surface of the drum 1 between the blade 6*a* and the charging roller 2 was observed. As a result, also in both of the cases of the weak bias and the strong bias, the positive fine particles which were passed through the charging bias end portion and were present on the drum 1 was observed. However, the amount of such positive fine particles in the case of the strong bias was considerably large.

From the above, it was found that the positive fine particles accumulated at the charging bias end portion were discharged from the end portion of the cleaning blade 6*a* when the toner forcedly charged to the positive polarity was sent to the charging bias end portion. This reason will be considered with reference to (a) to (c) of FIG. 10. Part (a) of FIG. 10 is a sectional view showing a state in which the positive fine particles G are accumulated in the wedge-like region 30 between the cleaning blade 6*a* and the drum 1 and the toner T of the solid image is carried toward the wedge-like region 30. Part (b) of FIG. 10 is a sectional view showing the case of the toner T charged to the positive polarity, and (c) of FIG. 10 is a sectional view showing the case of the toner T charged to the negative polarity. The drum 1 has the negative potential, so that adherence to the drum surface of the toner forcedly charged to the positive polarity is strong. For that reason, the positively charged toner T readily enters the wedge-like region 30 at the end portion of the cleaning blade 6*a*, so that it would be considered that the positive fine particles are pushed out by the entering to be readily passed through the charging bias end portion, thus being present on the drum 1 outside the wedge-like region 30 ((b) of FIG. 10). Incidentally, an average particle size of the toner is larger than that of the positive fine particles and therefore even when the positive fine particles come out of the charging bias end portion, the toner does not come out of the charging bias end portion. On the other hand, it would be considered that the toner which is charged to the negative polarity providing weak adherence to the drum 1 is removed from the surface of the drum 1 at a position where the toner does not so enter the end portion of the blade 6*a* and thus the effect such that the positive fine particles come out of the charging bias end portion is low ((c) of FIG. 10)

Although the toner is positively charged by the cleaning roller 13 also in the operation in the monochromatic mode, the toner is not collected in the stations Sy for Y, Sm for M and Sc for C. For that reason, it would be considered that the positively charged toner does not reach the cleaning blade 6*a* and thus the positive fine particles are accumulated at the end portion of the blade 6*a*.

Next, a mechanism for preventing the positive fine particles from being accumulated at the end portion of the blade 6*a* in this embodiment will be described.

In this embodiment, in the printing operation in the monochromatic mode, a discharging sequence different from the printing process is periodically executed during the non-image formation. In a reverse transfer sequence, in the station which is not subjected to the image formation in the operation in the monochromatic mode, a solid image (toner image) of a predetermined pattern is formed on the rotating drum 1. Thereafter, the toner of the toner image is forcedly charged to the positive polarity which is the opposite polarity to the negative polarity which is the normal charge polarity of the toner by applying the strong bias to the toner means 5 and then the positively charged toner is conveyed to the cleaning device 6 by further rotation of the drum 1.

As a result, the toner forcedly charged to the positive polarity is sent to the end portion of the blade 6*a* contacting the drum 1, so that the accumulated positive fine particles are discharged from the end portion of the blade 6*a*. That is, the positive fine particles present at the end portion of the blade 6*a* are passed through the blade end portion, so that the accumulation thereof at the blade end portion is suppressed. There is a possibility that the positive fine particles through the blade 6*a* are deposited on the charging roller 2. However, as in this embodiment, before the positive fine particles are accumulated in a large amount, the positive fine particles are caused to come out of the blade 6*a* little by little by sending the toner to the blade 6*a*, so that the charging roller period lateral white stripe image is not generated. This would be considered because even when the positive fine particles are deposited on the charging roller 2 in this embodiment, the positive fine particles are deposited in a dispersion manner and thus the deposited positive fine particles do not cause image defect. On the other hand, when the positive fine particles pass through the blade 6*a* after being accumulated in the large amount and then are deposited on the charging roller 2, the positive fine particles are concentratedly deposited only at the portion where the charging roller 2 is disposed, so that the image defect is generated.

Figure 7:
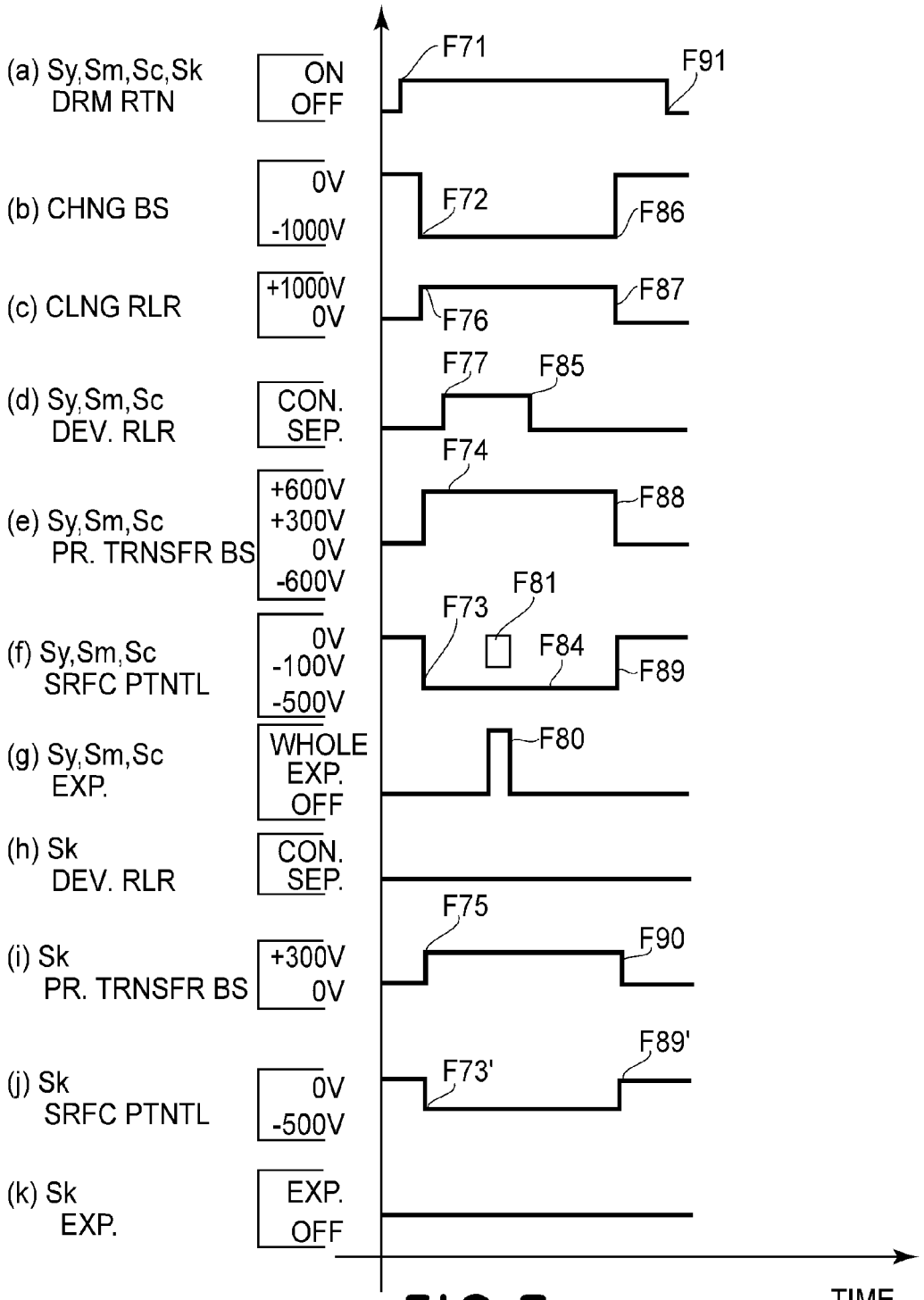
FIG. 7 is a control timing chart of an apparatus operation of a reverse transfer sequence.

With reference to FIG. 7, details of the discharging sequence performed by the control circuit portion B will be described.

1) In this embodiment, the control circuit portion B executes, when it receives an execution command of the discharging sequence during the operation in the monochromatic mode, the discharging sequence by re-actuating the main motor M after the job of the operation in the monochromatic mode is ended and then the main motor M is once stopped. That is, by the re-actuation of the motor M, the drums 1 in all the stations Sy, Sm, Sc and Sk and the belt 9 are started to be rotated (F71).

Then, a charging bias of −1000 V is applied from the charging bias power source E2 to the charging roller 2 (F72). As a result, the surface of the drum 1 is uniformly charged to the dark-portion potential VD=−500 V (F73, F73').

2) Together with this charging bias application, the strong bias of +600 V is applied to the primary transfer rollers 5*y*, 5*m* and 5*c* in the stations Sy for Y, Sm for M and Sc for C which are stations which are not subjected to the image formation during the execution of the job in the operation in the monochromatic mode (F74). The non-collection bias of +300 V is applied to the primary transfer roller 5*k* in the station Sk for K (F75). Together with this non-collection bias application, the cleaning bias of +1000 V is applied to the cleaning roller 13 (F76).

3) Then, the developing devices 4*y*, 4*m* and 4*c* in the stations Sy, Sm and Sc for colors of Y, M and C are moved from the non-development position to the development position, so that the developing rollers 4*ay*, 4*am* and 4*ac* are contacted to the drums 1*y*, 1*m* and 1*c* (F78). The developing device 4*k* is kept at the non-development position, so that the developing roller 4*ak* in the station Sk for K is prevented from being contacted to the drum 1*k*.

4) Thereafter, first, the exposure depending on the solid image of the predetermined pattern is effected by the scanner 3*y* in the station Sy for Y (F80), so that the electrostatic latent image is formed on the surface of the drum 1*k* (F81). In this embodiment, the solid image has a size of 220 mm (main scan direction)×20 mm (sub-scan direction). The surface of the drum 1*y* after the electrostatic latent image is formed thereon has the light-portion potential VL=−100 V. The electrostatic latent image formed on the drum 1*y* is developed by the developing roller 4*ay* to form the Y toner image. To the primary transfer roller 5*y*, the primary transfer bias of +600 V is applied.

Similarly, in the stations Sm for M and Sc for C, the solid images are formed and then the primary transfer bias of +600 V is applied to the primary transfer rollers 5*m* and 5*c*.

The toners of Y, M and C are formed with the density of about 0.15 on the drums 1*y*, 1*m* and 1*c* in the stations Sy, Sm and Sc, respectively. When each of the toners formed on the respective stations Sy, Sm and Sc is removed with the cleaning blade 6*a*, the toner is sent to the end portion of the blade 6*a* to cause the positive fine particles present at the end portion of the blade 6*a* to pass through the blade end portion.

That is, the control circuit portion B forms the toner images of the predetermined pattern on the rotating drums 1*y*, 1*m* and 1*c* in the stations Sy, Sm and Sc which are not subjected to the image formation during the non-image formation in the operation in the monochromatic mode. Then, the bias for charging the toners of the toner images of the predetermined pattern to the opposite polarity to the normal charge polarity of the toner is applied from the power sources E5*y*, E5*m* and E5*c* to the primary transfer rollers 5*y*, 5*m* and 5*c*. As a result, a series of discharging sequences in which the toners charged to the opposite polarity are conveyed to the cleaning devices 6*y*, 6*m* and 6*c* by further rotation of the drums 1*y*, 1*m* and 1*c*.

The toners (toner images) transferred on the belt 9 in the stations Sy, Sm and Sc for Y, M and C are conveyed to the downstream-side station. The drums 1*y*, 1*m* and 1*c* in the stations Sy, Sm and Sc for Y, M and C are still charged to the dark-portion potential VD=−500 V even after the image formation of the solid image is ended (F84). Therefore, the Y toner on the belt 9 is not collected in the stations Sm and Sc for M and C and is, as described later, also not collected in the station Sk for K and thus passes through the station Sk for K. Similarly, the M toner and the C toner are also not collected in the downstream-side station and pass through the downstream-side station.

Further, the developing rollers 4*ay*, 4*am* and 4*ac* in the stations Sy, Sm and Sc for Y, M and C are separated from the 1*y*, 1*m* and 1*c* immediately after the solid images are developed (F85).

5) On the other hand, in the station Sk for K, the negatively charged toners transferred from the upstream stations are conveyed. However, the photosensitive member surface is charged to the dark-portion potential and to which the non-collection bias is applied, and therefore the toners are not substantially collected in the station Sk for K.

Further, with timing when the drive of the belt 9 is started, the secondary transfer roller 12 is separated from the belt 9. Accordingly, the toners of Y, M and C passing through the station Sk for K pass below the secondary transfer roller 12 but the roller 12 is not contaminated with these toners.

6) The toners of Y, M and C on the belt 9 are charged to the positive polarity when the toners enter a position between the cleaning roller 13 and the belt 9. The positively charged toners are collected as they are on either of the drums 1*y*, 1*m* and 1*c* in the stations Sy, Sm and Sc for Y, M and C and then are collected in the cleaning device 6*y*, 6*m* and 6*c*.

When the transferred solid image of the Y toner passes through the cleaning roller 13 and then passes through the station Sc for C, all the biases are turned off (F86, F87, F88, F90). Thereafter, the rotation of the drums 1 and the belt 9 is stopped (F91), and then the image forming apparatus A is ready for a subsequent print request.

Incidentally, in this embodiment, after the predetermined job in the operation in the monochromatic mode is ended and then the main motor M is once stopped, the motor M is re-actuated to start the discharging sequence. The present invention is not limited thereto. In the case where an execution interval of the discharging sequence is controlled on the basis of a predetermined sheet number or the like, the operation may also go to the discharging sequence while continuing the rotation of the drums 1 during the non-image formation such as a sheet interval in the job or switching of speed.

Next, study on execution timing of the discharging sequence was made. In the operation in the monochromatic mode, a durability test in which monochromatic printing with a job of continuous two sheets was repeated was conducted. The positive fine particles accumulated at the end portion of the blade 6*a* is principally consisting of the abrasion powder. Therefore, when the abrasion amount of the drum 1 is large, the amount of the positive fine particles accumulated at the end portion of the blade 6*a* is correspondingly increased. Therefore, attention was paid to the abrasion amount between the execution intervals and a relation between the abrasion amount and the charging roller period lateral white stripe was studied.

By changing a condition of the execution interval of the discharging sequence performed during the durability test, an occurrence of the charging roller period lateral white stripe at the time of switching to the operation in the full-color mode was checked. The condition of the execution interval is 4 types of intervals of 250 sheets, 500 sheets, 750 sheets and 1000 sheets. Evaluation of an effect was made with each execution interval by printing a half-tone image on a 2999-th sheet in the operation in the full-color mode after the durability test on 2998 sheets in the operation in the monochromatic mode was conducted. That is, in each execution interval condition, the image evaluation was made immediately before the execution of the printing after the durability test.

The image was evaluated at the following three levels.

○: The charging roller period lateral white stripe did not occur.

Δ: The charging roller period lateral white stripe was acceptable.

x: The charging roller period lateral white stripe was not acceptable.

The result is shown in Table 1. In this experiment, the drum abrasion amount was 1.2 μm per 1000 sheets.

TABLE 1

| Interval* (sheets) | AA*2 (μm) | CRPLWS*3 |
|---|---|---|
| 250 | 0.4 | ○ |
| 500 | 0.6 | Δ |
| 750 | 0.8 | x |
| 1000 | 1.2 | x |

*1"Interval" represents the execution interval.
*2"AA" represents the abrasion amount until the printing of the half-tone image (in the operation in the full-color mode) is executed.
*3"CRPLWS" represents the charging roller period lateral white stripe.

As shown in Table 1, when the discharging sequence is executed during the non-image formation with the timing when the abrasion amount of the drum 1 is 0.6 μm or less as the execution interval, i.e., with the execution interval in which the abrasion amount of the drum 1 does not exceed a predetermined amount, it is possible to suppress the occurrence of the charging roller period lateral white stripe. That is, it would be considered that even in the case where the discharging sequence is executed, when the abrasion amount exceeds 0.6 μm, the positive fine particles principally comprising the abrasion powder are accumulated at the blade 6*a* and therefore it is difficult to suppress the occurrence of the charging roller period lateral white stripe. In this embodiment, the execution timing is determined on the basis of the interval of the predetermined number of sheets but the sequence may also be performed on the basis of the drum abrasion amount which is estimated or measured in advance.

As described above, the occurrence of the charging roller period lateral white stripe can be suppressed by executing the discharging sequence with the interval providing the predetermined abrasion amount or less under control of the abrasion amount of the drum 1, i.e., by executing the discharging sequence, depending on the abrasion amount of the surface of the drum 1, controlled by the control circuit portion B.

The execution timing of the above-described discharging sequence can be selected from the following various settings singly or in combination.

1) This setting is made in such a manner that the discharging sequence is executed by re-actuating the apparatus A during or after end of an ending operation (post-rotation) for the apparatus A, in which during the ending operation corresponds to during the non-image formation after a job on one sheet or a plurality of continuous sheets in the operation in the monochromatic mode is ended.

2) This setting is made in such a manner that the discharging sequence is executed by prolonging the sheet interval as during the non-image formation every ending (during the execution of the operation in the monochromatic mode on the plurality of continuous sheets) of the printing on the predetermined number of sheets.

3) This setting is made in such a manner that the discharging sequence is executed during the non-image formation with appropriate timing, when the job in the operation in the monochromatic mode is executed, depending on the drum abrasion amount which is estimated in advance in the durability test of the apparatus A. For example, in the case where the continuous image formation in the operation in the monochromatic mode is effected, the abrasion amount is estimated and then the discharging sequence can be performed.

An executing method of the discharging sequence on the basis of the estimation of the abrasion amount will be described as an example.

The drum abrasion amount can be estimated by the following equation (1):

$$Da=Kf\times Tf+Km\times Tm \quad (1),$$

where Da represents the drum abrasion amount from the execution of the preceding discharging sequence, Kf represents an abrasion coefficient per unit time in the operation in the full-color mode, Tf represents a drum rotation time in the operation in the full-color mode from the execution of the preceding discharging sequence, Km represents an abrasion coefficient per unit time in the operation in the monochromatic mode, and Tm represents a drum rotation time in the operation in the monochromatic mode from the execution of the preceding discharging sequence.

In the case where the drum abrasion amount Da obtained by the above equation (1) exceeds a threshold, the discharging sequence is executed during the ending operation (during the post-rotation) of the apparatus A, i.e., during the non-image formation after the end of the printing job.

As described above, in the case where the image formation is effected in the operation in the monochromatic mode, during the non-image formation, the toner is sent to the end portion of the blade 6*a*, with the interval providing the drum abrasion amount which does not exceed the predetermined amount, in the stations which are not subjected to the image formation. As a result, it is possible to suppress the accumulation of the positive fine particles present at the end portion of the blade 6*a*, so that it becomes possible to suppress the occurrence of the charging roller period lateral white stripe when the image is outputted in the operation in the full-color mode.

Incidentally, in this embodiment, during the discharging sequence, the strong bias of +600 V is applied to the primary transfer rollers 5*y*, 5*m* and 5*c* but the transfer bias may appropriately be set at another value depending on the apparatus constitution. It is important that at the position of the transfer roller 5, the toner is charged to the opposite polarity to the normal charge polarity of the toner. Whether or not the toner is charged to the opposite polarity can be discriminated by the following experiment. With respect to the toner image formed on the drum, each of the toner before being charged to the opposite polarity by the primary transfer roller 5 and the toner after being charged to the opposite polarity by the primary transfer roller 5 is collected and then is subjected to measurement of a distribution of a toner charge amount. The toner charge amount is measured by using a measuring device ("Espart Analyzer" (trade name), mfd. by Hosokawa Micron Corp.). The collected toner particles are blown off with nitrogen gas and are introduced into a measuring portion (measuring cell) of the measuring device via a sampling opening. The toner particles are subjected to measurement until 3000 toner particles are counted, so that the distribution of the toner charge amount is outputted on a graph. From its result, it was confirmed that the toner charged to the opposite polarity by the primary transfer roller is, compared with the toner before being charged to the opposite polarity by the primary transfer roller, increased in amount of the toner charged to the opposite polarity.

Embodiment 2

Figure 8:
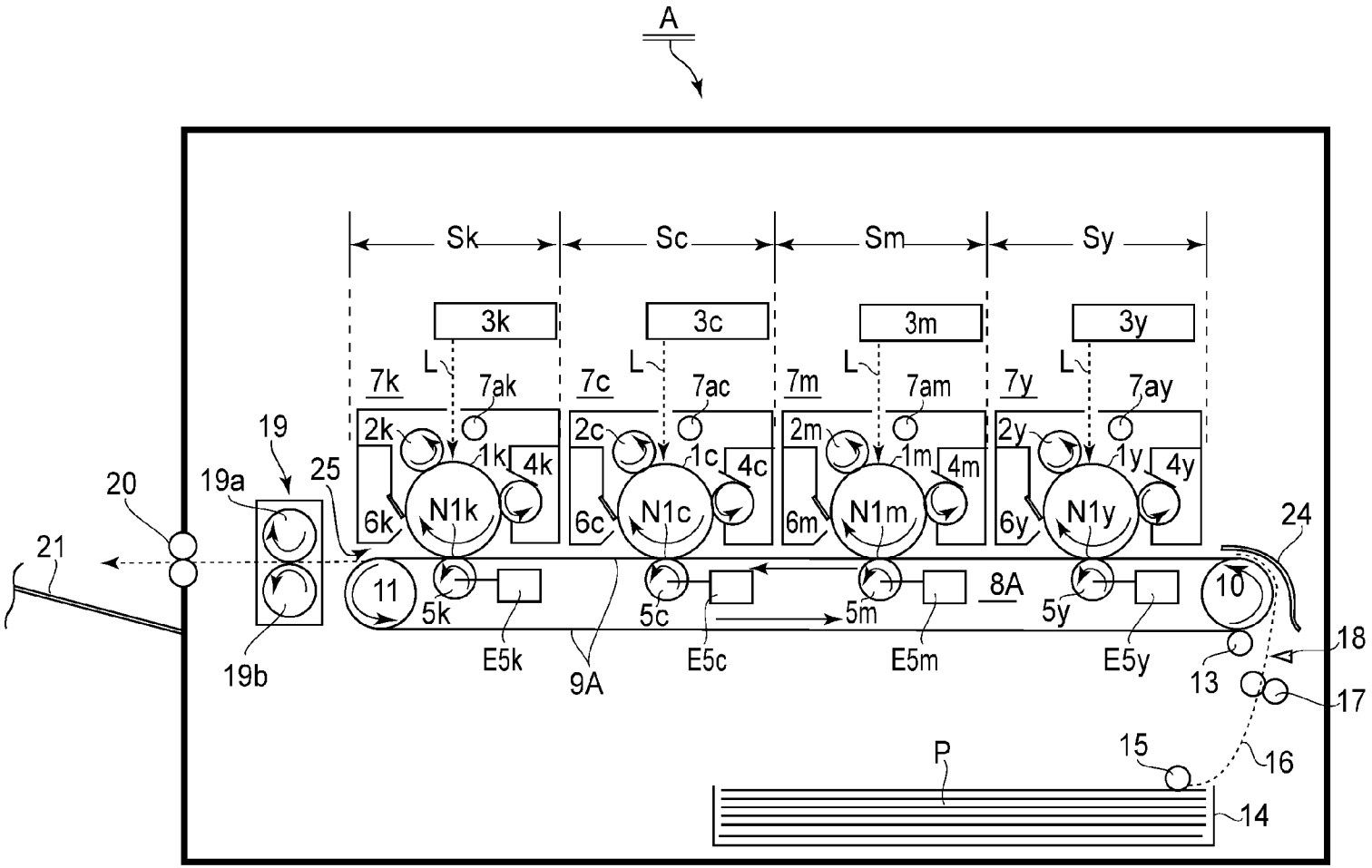
FIG. 8 is a schematic illustration of an image forming apparatus (of a direct transfer type) in Embodiment 2.

FIG. 8 is a schematic illustration of an image forming apparatus A in this embodiment. This apparatus A is prepared by changing the intermediary transfer type in the apparatus A in Embodiment 1 to a direct transfer type. Constituent members or portions common to the apparatuses A in Embodiments 1 and 2 are represented by the same reference numerals or symbols and will be omitted from redundant description.

The intermediary transfer unit 8 in the apparatus A in Embodiment 1 corresponds to a recording material conveying unit 8 in this embodiment. The intermediary transfer belt 9 is changed to a recording material conveying belt 9A as a recording material conveying member. Further, the secondary transfer roller 12 is omitted.

The recording material P fed from the recording material cassette 14 is conveyed with predetermined control timing by the timing roller pair 17 and the timing sensor 18 and then is supplied along a guide 24 from the driving roller 10 side to the upper belt portion of the belt 9A. Then, by rotation of the belt 9A on which the recording material P is carried, the recording material P passes through the transfer nips N1*y*, N1*m*, N1*c* and N1*k* in the first to fourth image forming stations Sy, Sm, Sc and Sk in this order, thus being conveyed to the opposite roller 11 side.

In the case where the selected mode is the full-color mode (multi-color image forming mode), all the first to fourth image forming stations Sy, Sm, Sc and Sk perform the image forming operation. As a result, a plurality of developer images are directly and successively transferred superposedly onto the recording material P carried and conveyed on the belt 9A. The control is effected in accordance with the timing chart of FIG. 5.

In the case where the selected mode is the monochromatic mode (single-color image forming mode), only one of the first to fourth image forming stations Sy, Sm, Sc and Sk performs the image forming operation. As a result, the developer image of the associated single color formed on the drum in the associated image forming station is directly transferred onto the recording material P carried and conveyed on the belt 9A. The control is effected in accordance with the timing chart of FIG. 6.

Further, the control of the discharging sequence as the means for suppressing the occurrence of the charging roller period lateral white stripe in the execution of the operation in the monochromatic mode is effected in accordance with the timing chart of FIG. 7.

The recording material P conveyed to the opposite roller 11 while being carried on the belt 9A is curvature-separated from or separated by a separating member (not shown), such as a separation claw, from the belt 9A at a recording material separation position 25. As a result, the unfixed toner image on the recording material P is fixed as the fixed image. The recording material P coming out of the fixing device 19 is discharged, as a full-color image-formed product or a monochromatic (single-color) image-formed product, onto the discharging tray 21 by the discharging roller pair 20.

Further, it is also possible to employ the same constitution of the execution timing or the like of the discharging sequence as that in Embodiment 1.

Other Embodiments (1) Each image forming portion is not limited to the image forming mechanism of the electrophotographic type in the embodiments described above. Each image forming portion may also be an image forming mechanism of an electrostatic recording type using an electrostatic recording dielectric member as the image bearing member and an image forming mechanism of a magnetic recording type using a magnetic recording magnetic member as the image bearing member.

(2) The intermediary transfer member or the recording material carrying member is not limited to the endless belt member used in the embodiments described above. The member may also be a drum member.

(3) The plurality of the image forming portions are not limited to the four image forming portions as in the above-described embodiments. Two, three or five or more image forming portions may also be used. The color of the toner may also be transparent or white.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 132877/2011 filed Jun. 15, 2011 and 097657/2012 filed Apr. 23, 2012, which are hereby incorporated by reference.

What is claimed is:

1. An image forming apparatus for forming an image on a recording material, comprising:

an intermediary transfer member onto which a plurality of developer images are to be transferred;

a plurality of image forming portions provided along a movement direction of said intermediary transfer member, wherein each of said image forming portions includes a rotatable image bearing member, a rotatable charging roller, for electrically charging uniformly a surface of said image bearing member, in contact with said image bearing member, and developing means for developing an electrostatic latent image formed on said image bearing member into a developer image by reverse development;

a plurality of first transfer means, provided correspondingly to said image bearing members of said image forming portions, respectively, each for transferring the developer image from said image bearing member onto said intermediary transfer member;

a plurality of cleaning means, provided correspondingly to said image bearing members of said image forming portions, respectively, where each of said cleaning means includes a cleaning blade and is configured to remove a developer remaining on said image bearing member after the developer image is transferred from said image bearing member onto said intermediary transfer member;

second transfer means for transferring the plurality of developer images from said intermediary transfer member onto the recording material; and control means for executing, by mode selection, an operation in a multi-color image forming mode in which the developer images of a plurality of colors are superposed on said intermediary transfer member by image forming operations of said image forming portions to effect multi-color image formation and an operation in a single-color image forming mode in which the developer image of a single color is transferred onto said intermediary transfer member by an image forming operation of one of said image forming portions to effect single-color image formation, wherein said control means executes, during the execution of the operation in the single-color image forming mode, a sequence in which the developer image is formed on said image bearing member at said image forming portion which does not operate for the image formation, and a bias voltage for charging the developer for the developer image to an opposite polarity to a normal charge polarity of the developer is applied to said first transfer means to permit the developer charged to the opposite polarity to reach said cleaning means.

2. An apparatus according to claim 1, further comprising developer charging means for charging the developer, to the opposite polarity to the normal charge polarity of the developer, deposited on the intermediary transfer member at a position downstream of said second transfer means and upstream of the upstreammost image forming portion of said image forming portions with respect to a movement direction of said intermediary transfer member.

3. An apparatus according to claim 1, further comprising common charging bias applying means for applying a charging bias to said charging roller.

4. An apparatus according to claim 1, wherein said control means estimates an abrasion amount of the surface of said image bearing member and executes the sequence on the basis of the abrasion amount.

5. An apparatus according to claim 1, further comprising measuring means for measuring information on an abrasion amount of the surface of said image bearing member, wherein said control means executes the sequence on the basis of information on the abrasion amount measured by said measuring means.

6. An apparatus according to claim 1, wherein said control means executes the sequence when the image formation on a predetermined number of sheets of the recording material is continuously effected by the operation in the single-color image forming mode.

7. An apparatus according to claim 1, wherein at each of said image forming portions, said image bearing member is a photosensitive member, and wherein each of said image forming portions includes image exposure means for forming the electrostatic latent image on the surface of said image bearing member charged by said charging roller.

8. An image forming apparatus for forming an image on a recording material, comprising:

a recording material conveying member which is movable while carrying thereon the recording material;

a plurality of image forming portions provided along a movement direction of said recording material conveying member, wherein each of said image forming portions includes a rotatable image bearing member, a rotatable charging roller for electrically charging uniformly a surface of said image bearing member in contact with said image bearing member, and developing means for developing an electrostatic latent image formed on said image bearing member into a developer image by reverse development;

a plurality of transfer means, provided correspondingly to said image bearing members of said image forming portions, respectively, each for transferring the developer image from said image bearing member onto the recording material carried and conveyed by said recording material conveying member;

a plurality of cleaning means, provided correspondingly to said image bearing members of said image forming portions, respectively, where each of said cleaning means includes a cleaning blade and is configured to remove a developer remaining on said image bearing member after the developer image is transferred from said image bearing member onto the recording material; and control means for executing, by mode selection, an operation in a multi-color image forming mode in which the developer images of a plurality of colors are superposed on the recording material carried and conveyed by said recording material conveying member by image forming operations of said image forming portions to effect multi-color image formation and an operation in a single-color image forming mode in which the developer image of a single color is transferred onto the recording material carried and conveyed by said recording material conveying member by an image forming operation of one of said image forming portions to effect single-color image formation, wherein said control means executes, during the execution of the operation in the single-color image forming mode, a sequence in which the developer image is formed on said image bearing member at said image forming portion which does not operate for the image formation, and a bias voltage for charging the developer for the developer image to an opposite polarity to a normal charge polarity of the developer is applied to said first transfer means to permit the developer charged to the opposite polarity to reach said cleaning means.

9. An apparatus according to claim 8, further comprising developer charging means for charging the developer, to the opposite polarity to the normal charge polarity of the developer, deposited on said recording material conveying member at a position downstream of a recording material separation position, where a leading end portion of the recording material which is carried and conveyed by said recording material conveying member and which passes through the downstreammost image forming portion of said image forming portions is separated from said recording material conveying member, and upstream of the upstreammost image forming portion of said image forming portions with respect to a movement direction of said intermediary transfer member.

10. An apparatus according to claim 8, further comprising common charging bias applying means for applying a charging bias to said charging roller.

11. An apparatus according to claim 8, wherein said control means estimates an abrasion amount of the surface of said image bearing member and executes the sequence on the basis of the abrasion amount.

12. An apparatus according to claim 8, further comprising measuring means for measuring information on an abrasion amount of the surface of said image bearing member, wherein said control means executes the sequence on the basis of information on the abrasion amount measured by said measuring means.

13. An apparatus according to claim 8, wherein said control means executes the sequence when the image formation on a predetermined number of sheets of the recording material is continuously effected by the operation in the single-color image forming mode.

14. An apparatus according to claim 8, wherein at each of said image forming portions, said image bearing member is a photosensitive member, and wherein each of said image forming portions includes image exposure means for forming the electrostatic latent image on the surface of said image bearing member charged by said charging roller.

15. An image forming apparatus for forming an image on a recording material, comprising:

a plurality of image forming portions for forming images, wherein each of said image forming portions includes an image bearing member, a charging member, for electrically charging a surface of said image bearing member, in contact with said image bearing member, and developing means for developing a latent image formed on said image bearing member into a developer image;

a plurality of transfer means provided correspondingly to said image bearing members of said image forming portions;

a plurality of cleaning means provided correspondingly to said image bearing members, where each of said cleaning means includes a cleaning blade which is in contact with said image bearing member and is configured to remove a developer remaining on said image bearing member after the developer image is transferred from said image bearing member; and control means for executing, by mode selection, an operation in a multi-color image forming mode in which developer images of a plurality of colors are formed by image forming operations to effect multi-color image formation and an operation in a single-color image forming mode in which the developer image of a single color is transferred by an image forming operation of one of said image forming portions to effect single-color image formation, wherein said control means executes, during or after the execution of the operation in the single-color image forming mode, a sequence in which the developer image is formed on said image bearing member at said image forming portion which does not operate for the image formation, and a bias voltage for charging the developer for the developer image to an opposite polarity to a normal charge polarity of the developer is applied to said transfer means to permit the developer charged to the opposite polarity to reach said cleaning means.

16. An apparatus according to claim 15, further comprising developer charging means for charging the developer, to the opposite polarity to the normal charge polarity of the developer, deposited at a position downstream of said transfer means and upstream of the upstreammost image forming portion of said image forming portions.

17. An apparatus according to claim 15, further comprising common charging bias applying means for applying a charging bias to said charging member.

18. An apparatus according to claim 15, wherein said control means estimates an abrasion amount of the surface of said image bearing member and executes the sequence on the basis of the abrasion amount.

19. An apparatus according to claim 15, further comprising measuring means for measuring information on an abrasion amount of the surface of said image bearing member, wherein said control means executes the sequence on the basis of information on the abrasion amount measured by said measuring means.

20. An apparatus according to claim 15, wherein said control means executes the sequence when the image formation on a predetermined number of sheets of the recording material is continuously effected by the operation in the single-color image forming mode.

21. An apparatus according to claim 15, wherein at each of said image forming portions, said image bearing member is a photosensitive member, and wherein each of said image forming portions includes image exposure means for forming the latent image on the surface of said image bearing member charged by said charging member.

22. An image forming apparatus for forming an image on a recording material, comprising:

a plurality of image forming portions for forming images, wherein each of said image forming portions includes an image bearing member, a charging member, for electrically charging a surface of said image bearing member, in contact with said image bearing member, and developing means for developing a latent image formed on said image bearing member into a developer image;

transfer means for transferring the developer image from said image bearing member;

cleaning means for removing the developer remaining on said image bearing member after the developer image is transferred from said image bearing member, where said cleaning means includes a cleaning blade which is in contact with said image bearing member; and control means for executing at least an operation in a single-color image forming mode in which a developer image of a single color is formed by an image forming operation of one of said image forming portions to effect single-color image formation, wherein said control means executes, during or after the execution of the single-color image forming mode operation, a sequence in which the developer image is formed on said image bearing member at said image forming portion which does not operate for the image formation, and a bias voltage for charging the developer for the developer image to an opposite polarity to a normal charge polarity of the developer is applied to said transfer means to permit the developer charged to the opposite polarity to reach said cleaning means.

23. An apparatus according to claim 22, further comprising developer charging means for charging the developer, to the opposite polarity to the normal charge polarity of the developer, deposited at a position downstream of said transfer means and upstream of the upstreammost image forming portion of said image forming portions.

24. An apparatus according to claim 22, further comprising common charging bias applying means for applying a charging bias to said charging member.

25. An apparatus according to claim 22, wherein said control means estimates an abrasion amount of the surface of said image bearing member and executes the sequence on the basis of the abrasion amount.

26. An apparatus according to claim 22, further comprising measuring means for measuring information on an abrasion amount of the surface of said image bearing member, wherein said control means executes the sequence on the basis of information on the abrasion amount measured by said measuring means.

27. An apparatus according to claim 22, wherein said control means executes the sequence when the image formation on a predetermined number of sheets of the recording material is continuously effected by the operation in the single-color image forming mode.

28. An apparatus according to claim 22, wherein at each of said image forming portions, said image bearing member is a photosensitive member, and wherein each of said image forming portions includes image exposure means for forming the latent image on the surface of said image bearing member charged by said charging member.

* * * * *